US006154621A

United States Patent [19]

Yamamoto et al.

[11] Patent Number: 6,154,621

[45] Date of Patent: Nov. 28, 2000

[54] IMAGE FORMING APPARATUS THAT IS CAPABLE OF ALTERING A RECORDING SHEET TRANSPORTING SPEED

[75] Inventors: Keiji Yamamoto; Makoto Ochiai; Masato Saito; Naoki Hirako, all of Ebina, Japan

[73] Assignee: Fuji Xerox Co., Ltd., Tokyo, Japan

[21] Appl. No.: 09/384,209

[22] Filed: Aug. 27, 1999

[30] Foreign Application Priority Data

Sep. 18, 1998 [JP] Japan ..... 10-265530

[51] Int. Cl.[7] ..... G03G 15/20

[52] U.S. Cl. ..... 399/68; 347/153; 399/302; 399/308

[58] Field of Search ..... 399/68, 66, 67, 399/45, 302, 303, 308, 312; 219/216; 347/153, 154

[56] References Cited

U.S. PATENT DOCUMENTS

| | | | |
|---|---|---|---|
| 4,595,279 | 6/1986 | Kuru et al. | 399/45 |
| 5,249,024 | 9/1993 | Menjo | 399/45 |
| 5,260,751 | 11/1993 | Inomata | 399/68 |
| 6,057,869 | 5/2000 | Kawaishi et al. | 347/153 |

FOREIGN PATENT DOCUMENTS 9-171277 6/1997 Japan .

*Primary Examiner*—Quana M. Grainger
*Attorney, Agent, or Firm*—Oliff & Berridge, PLC

[57] ABSTRACT

An image forming apparatus is provided which can compatibly realize maintenance of optimum fixing speeds according to fixing characteristics of recording sheets and toner images and a reduction in the size of the apparatus itself as well as an improvement in the productivity of image formation, and which is free of many restrictions such as sizes, transfer speeds, fixing speeds and transfer positions of recording media to be used as well as lengths and fixing positions of transporting units. An image forming apparatus comprises a transfer section for transferring a toner image to recording sheets at a predetermined transfer speed, a fixing section for fixing the toner image transferred to the recording sheet at a predetermined fixing speed, a transporting device for continuously transporting the recording sheet from the transfer section to the fixing section at a predetermined transporting speed and with a predetermined space, a control device for controlling a transporting speed of the transporting device so that a transporting speed and a fixing speed of the recording sheet become approximately equal to each other when a leading edge of the recording sheet reaches the fixing section, a detecting device for detecting a transporting-direction length of the recording sheet, and a space control device for controlling a space between a preceding recording sheet and a succeeding recording sheet according to a transporting-direction length of the preceding recording sheet of recording sheets.

9 Claims, 14 Drawing Sheets

IMAGE FORMING APPARATUS THAT IS CAPABLE OF ALTERING A RECORDING SHEET TRANSPORTING SPEED

BACKGROUND OF THE INVENTION

1. Field of the Invention

The present invention relates to an image forming apparatus such as a xerographic type of copying machine or printer and, more specifically, to an image forming apparatus which has transporting means for transporting a recording sheet between a transfer section for transferring a toner image to the recording sheet and a fixing section for fixing the toner image transferred to the recording sheet and is capable of changing the recording-sheet transporting speed of the transporting means.

2. Description of the Related Art

A conventional type of image forming apparatus such as a xerographic type of copying machine or printer is constructed to transfer a toner image formed on a photoconductor drum to a recording sheet by means of a transfer section, transport the recording sheet to which the toner image was transferred to a fixing section by means of transporting means, and fuse and fix the toner image to the recording sheet by heat and pressure by means of a fixing unit provided in the fixing section, thereby forming an image.

In the fixing unit, since a toner image is fused and fixed to a recording sheet by heat and pressure, it is necessary to set its fixing speed according to a fixing characteristic due to the thickness of the recording sheet or the like or a fixing characteristic due to the kind of toner image. Specifically, in the case of a recording sheet or toner image which is difficult to fix, it is necessary to set the fixing speed to a slow speed, while in the case of a recording sheet or toner image which is easy to fix, it is necessary to set the fixing speed to a fast speed. In this respect, the fixing unit differs from the transfer section which electrostatically transfer a toner image formed on the photoconductor drum, at an approximately constant transfer speed. For this reason, in general, the time required for fixing in the fixing unit, i.e., the recording-sheet transporting speed (fixing speed) in the fixing unit, differs from the recording-sheet transporting speed (transfer speed) in the transfer section. Accordingly, when a recording sheet is to be transported from the transfer section to the fixing section, it becomes necessary to adjust the transporting speed of the recording sheet.

To adjust the transporting speed of the recording sheet, it is more desirable that the transporting path from the transfer section to the fixing section be made longer, because a speed difference between the transfer speed and the fixing speed is easier to be absorbed and a sufficient fixing time can be ensured.

On the other hand, to reduce the size of the image forming apparatus, it is more desirable to make the recording-sheet transporting path shorter.

An art for reducing the size of the apparatus while maintaining optimum fixing speed conditions is disclosed in, for example, Japanese Patent Laid-Open No. 171277/1997. This specification proposes a recording medium transporting system for a xerographic apparatus which defines the relationships between a distance $l_1$ from a transfer position to the entrance-side axis of a transfer belt, a distance $l_2$ from the entrance side to the exit side of the transfer belt, a distance $l_3$ from the exit side of the transfer belt to a speed change point, a distance $l_4$ from the speed change point to a fixing roller, a maximum length $A_{max}$ of a usable recording sheet, a minimum length $A_{min}$ of a usable recording sheet, a transfer speed $V_1$ and a fixing speed $V_2$, thereby making it possible to minimize the size of a transporting system which leads to a fixing section from the toner image transfer position, particularly, the length of the transporting belt or the distance to a nip position of the fixing roller.

However, this proposal has the problem that the size, transfer speed, fixing speed and transfer position of a recording medium to be used as well as the length, fixing position and the like of a transporting unit impose restrictions on one another, thereby hindering free layout of individual units.

SUMMARY OF THE INVENTION

The present invention has been made in view of the above-described problems of the prior art, and an object of the present invention is to provide an image forming apparatus which can compatibly realize maintenance of optimum fixing speeds according to fixing characteristics of recording sheets and toner images and a reduction in the size of the apparatus itself as well as an improvement in the productivity of image formation, and which is free of many restrictions such as sizes, transfer speeds, fixing speeds and transfer positions of recording media to be used as well as lengths and fixing positions of transporting units.

In accordance with a first aspect of the present invention, there is provided an image forming apparatus comprising a transfer section for transferring a toner image formed on an image carrier by a xerographic process to recording sheets at a predetermined transfer speed, a fixing section for fixing the toner image transferred to the recording sheet to the recording sheet at a predetermined fixing speed different from the predetermined transfer speed, the fixing section being disposed so that a distance between the fixing section and the transfer section is longer than a maximum transporting-direction length of a recording sheet on which an image can be formed, transporting means for continuously transporting the recording sheet from the transfer section to the fixing section at a predetermined transporting speed and with a predetermined space, control means for controlling a transporting speed of the transporting means so that a transporting speed and a fixing speed of the recording sheet become approximately equal to each other when a leading edge of the recording sheet transported by the transporting means reaches the fixing section, and space control means for controlling a space between a preceding recording sheet and a succeeding recording sheet according to a transporting-direction length of the preceding recording sheet of recording sheets which are continuously transported by the transporting means.

FIG. 1 is a view illustrating the concept of the present invention. Since the image forming apparatus is constructed in the manner shown in FIG. 1, the above-described problems can be solved by an operation which will be described below. The fixing section performs fixing at an optimum fixing speed according to the fixing characteristics of a recording sheet and a toner image, and the fixing speed of the fixing section in general differs from a transfer speed which is substantially the same as an image forming process speed. If the recording sheet fed out of the transfer section at the transfer speed enters the fixing section at the same speed, there is a risk that a shock occurring at that time damages a toner image on the recording sheet or causes a jam of the recording sheet or the like. However, these problems do not occur, because the speed control means controls the transporting speed $V_T$ of the transporting means so that the transporting speed $V_T$ and the fixing speed $V_F$ of the recording sheet become approximately equal to each other at least when the leading edge of the recording sheet reaches the fixing section.

In addition, to effect such speed control while preventing folding of a recording sheet which may damage an unfixed toner image, it is necessary that the distance between the transfer section and the fixing section be longer than the transporting-direction length of a recording sheet on which an image can be formed. Furthermore, to conduct such speed control, as the distance between the transfer section and the fixing section is made longer, the speed control becomes easier to perform, but the size of the image forming apparatus becomes larger and the productivity of image formation becomes lower. On the other hand, if the size, transfer speed, fixing speed and transfer position of a recording sheet to be used and the length, fixing position and the like of a transporting unit are optimally defined, it is possible to shorten the distance between the transfer section and the fixing section and approximately effect speed control while realizing a reduction in the size of the image forming apparatus and an improvement in the productivity of image formation, but free layouts and the like in the apparatus are hindered. To cope with this problem, this invention appropriately executes speed control to dynamically control a space X between the preceding recording sheet and the succeeding recording sheet in accordance with detecting means for detecting a transporting-direction length L of a recording sheet and the transporting-direction length of the preceding recording sheet, thereby ensuring the free layout of individual units in the apparatus while realizing a reduction in the size of the apparatus and an improvement in the productivity of image formation.

Incidentally, the image carrier is matter which temporarily holds a toner image, and includes, for example, intermediate transfer rotating members such an intermediate transfer belt and an intermediate transfer drum and photoconductive rotating members such as a photoconductor drum and a photoconductor belt.

In accordance with a second aspect of the present invention, there is provided an image forming apparatus in which when the fixing section fixes the toner image to the recording sheet at a fixing speed corresponding to a fixing characteristic of the recording sheet and/or the toner image, the space control means controls the space X between the preceding recording sheet and the succeeding recording sheet according to the fixing speed.

In the second aspect, the fixing characteristic of the recording sheet means the extent of easiness of fixing of the recording sheet, and depends on the material, weight and the like of the recording sheet. The fixing characteristic of the toner image means the extent of easiness of fixing of the toner image, and depends on the kind of image such as a monochromatic image, a full color image, a solid image and a character image. In the case of a recording sheet or toner image which is difficult for the fixing section to fix, the fixing speed may be set to a slow speed, while in the case of a recording sheet or toner image which is easy for the fixing section to fix, the fixing speed may be set to a fast speed. In either case, the space control means dynamically controls the space X between the preceding recording sheet and the succeeding recording sheet according to the fixing speed, thereby enabling a further improvement in the productivity of image formation.

In the second aspect, the space control means controls the space X according to the fixing speed, but need not necessarily control the space X according to the fixing speed itself. Specifically, since, as described above, the fixing speed is changed on the basis of the fixing characteristic of a recording sheet or the fixing characteristic of a toner image, the space control means may directly determine the fixing characteristic of the recording sheet (such as the material, weight or the like of the recording sheet) or the fixing characteristic of the toner image (such as the kind of image such as a monochromatic image, a full color image, a solid image and a character image) and control the space X according to these fixing characteristics.

In accordance with a third aspect of the present invention, there is provided an image forming apparatus in which when the transporting means includes a plurality of transporting units and the speed control means independently controls transporting speeds of the respective transporting units, the space control means controls the space between the preceding recording sheet and the succeeding recording sheet according to the transporting speeds of the respective transporting units controlled independently.

In the third aspect, if the transporting means includes the plurality of transporting units and the speed control means independently controls the transporting speeds of the respective transporting units, the transporting speed $V_T$ of the transporting unit of the plurality of transporting units that is not transporting a recording sheet whose leading edge has reached the fixing section need not coincide with the fixing speed $V_F$ which is generally low, whereby more rapid transportation of a recording sheet is enabled and the productivity of image formation is improved. However, if the space X between recording sheets is made excessively narrow by the space control, there may also be a case in which the transporting speed $V_T$ of a transporting unit which is not transporting a recording sheet whose leading edge has reached the fixing section must coincide with the fixing speed $V_F$, with the result that the space control may lower the productivity of image formation. In the present invention, however, since the space control means dynamically controls the space between the preceding recording sheet and the succeeding recording sheet according to the transporting speeds of the respective transporting units controlled independently, it is possible to prevent the above-described problem, thereby making it possible to improve the productivity of image formation.

In accordance with a fourth aspect of the present invention, there is provide an image forming apparatus in which the space control means determines the space X between the preceding recording sheet and the succeeding recording sheet on the basis of a linear expression of L which is:

$$X=a+b\times L,$$

wherein L represents a transporting-direction length of the preceding recording sheet and a and b represent constants determined on the basis of a transporting condition.

By determining the constants a and b on the basis of a transporting condition such as transfer speed, transfer position, the length of a transporting unit or fixing position in this manner, it is possible to easily obtain the space X between recording sheets which can improve the productivity of image formation.

In accordance with a fifth aspect of the present invention, there is provided an image forming apparatus in which the constants a and b are determined on the basis of the fixing speed $V_F$ and/or the transporting speed $V_T$.

By determining the constants a and b on the basis of the fixing speed $V_F$ and/or the transporting speed $V_T$ in this manner, it is possible to easily obtain the space X between recording sheets which can improve the productivity of image formation.

In accordance with a sixth aspect of the present invention, there is provided an image forming apparatus in which when the fixing section selects a fixing speed from among a plurality of fixing speeds predetermined according to the fixing characteristic of the recording sheet and/or the toner image and fixes the toner image to the recording sheet at the selected fixing speed, the space control means determines the constants a and b by selecting a set of constants a and b from among a plurality of set of constants a and b predetermined according to the plurality of fixing speeds.

Because the constants a and b are determined in this manner, the space control means does not need to compute the constants a and b each time the space control means performs control, thereby making it possible to realize a simpler and more inexpensive image forming apparatus.

The above and other objects, features and advantages of the present invention will become apparent from the following detailed description of preferred embodiments of the present invention, taken in conjunction with the accompanying drawings.

DESCRIPTION OF THE PREFERRED EMBODIMENTS

Preferred embodiments of the present invention will be described below with reference to the accompanying drawings.

Embodiment 1

Figure 1:
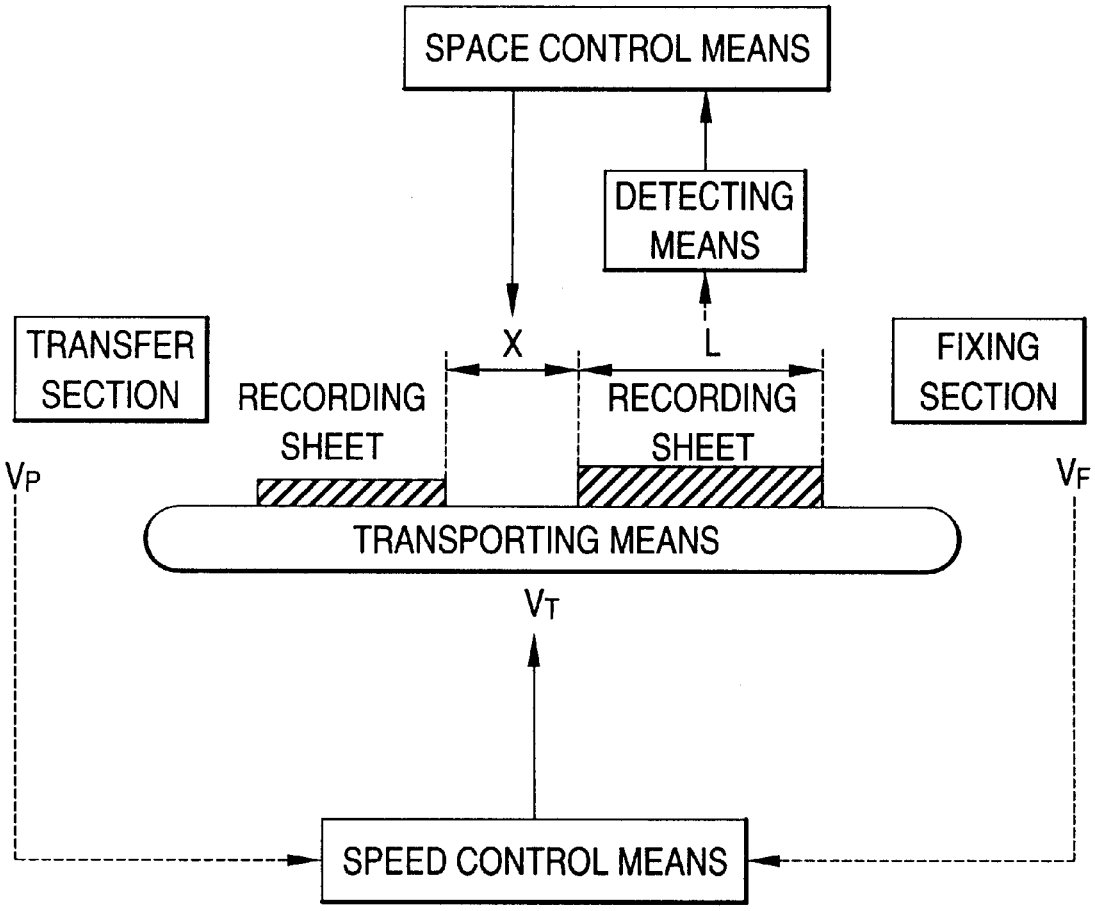
FIG. 1 is a view illustrating the concept of the present invention.
Figure 2:
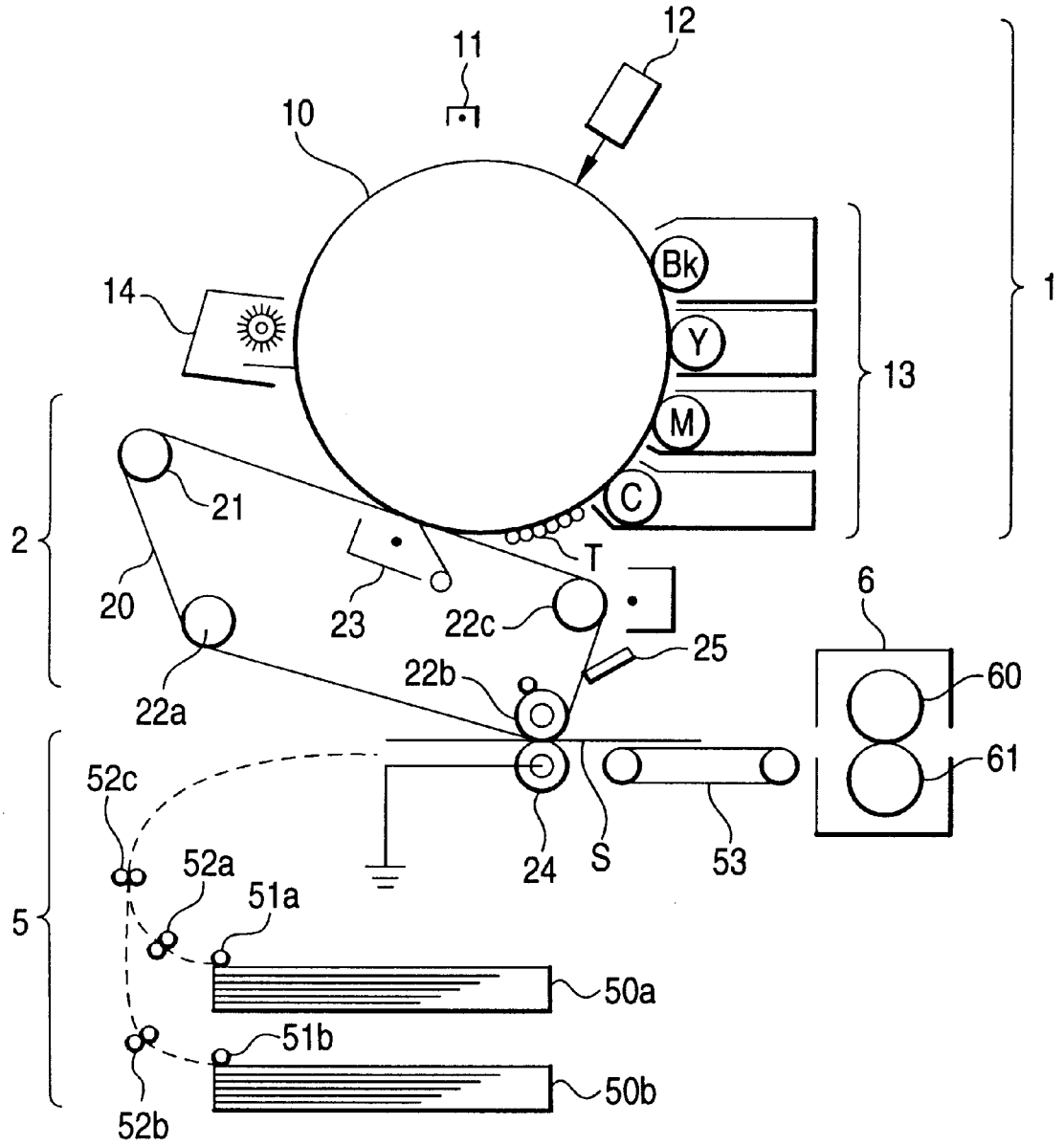
FIG. 2 is a view illustrating the construction of an image forming apparatus according to Embodiment 1.

FIG. 2 shows the construction of an image forming apparatus (color printer) according to the present embodiment, and the image forming apparatus mainly includes an image forming section 1, an intermediate transfer section 2, a transporting system section 5 and a fixing unit 6.

The image forming section 1 includes a photoconductor drum 10, a charger 11, an exposure unit 12, a developing unit 13, a photoconductor cleaning unit 14 and the like. The developing unit 13 is provided with developing parts Bk (black), Y (yellow), C (cyan) and M (magenta). The intermediate transfer section 2 includes an intermediate transfer belt (image carrier) 20, a driving roll 21, tension rolls 22*a*, 22*b* and 22*c*, primary transfer unit (transfer corotoron) 23, a secondary transfer unit (transfer section), a belt cleaner 25 and the like. The secondary transfer unit includes a transfer roll 24, a backup roll (the tension roll 22*b*) and the like, and a secondary transfer bias voltage of the same polarity as the charge polarity of toner is applied to the backup roll by a power supply (not shown). The fixing unit (fixing section) 6 includes a heating roll 60 which has a heat source in its inside, and a pressure roll 61.

The transporting system section 5 includes recording-sheet-S trays 50*a* and 50*b*, pickup rolls 51*a* and 51*b*, transporting roll pairs 52*a*, 52*b* and 52*c*, a register roll pair (not shown), a belt transporting unit (transporting means) 53 and the like. The intermediate transfer belt 20 is of a seamless type formed of a material prepared by incorporating an appropriate amount of antistatic material such as carbon black into a resin such as acrylic, polyvinyl chloride, polyester, polycarbonate or polyamide, or into one kind selected from various rubbers, and is formed to have a thickness of, for example, 0.1 mm and its volume resistivity is adjusted to $10^6$–$10^{14}$ Ω·cm. A reference mark is attached to the intermediate transfer belt 20 by printing or as reflective tape, and a sensor reads the reference mark to adjust timing for color matching or the like.

The operation of forming a full color image by means of the above-described image forming apparatus will be described below. The surface of the photoconductor drum 10 is charged to a uniform predetermined voltage by the charger 11. Then, the surface of the photoconductor drum 10 is illuminated with a laser beam by the exposure unit 12 corresponding to a image with black component, and an electrostatic latent image due to a potential difference is formed on the surface of the photoconductor drum 10. The electrostatic latent image is developed with toner by the black developing part 13 (Bk), thereby forming a black toner developed image. With the rotation of the photoconductor drum 10, this black toner image moves to a primary transfer position at which the black toner image comes into contact with the intermediate transfer belt 20. At this time, the black toner image is primarily transferred to the intermediate transfer belt 20 by the action of an electric field by the primary transfer unit 23. The remaining black toner which is left by a small amount on the surface of the photoconductor drum 10 without being primarily transferred is cleaned by the photoconductor cleaning unit 14 on a downstream side. This image forming process is performed on each color of yellow, magenta and cyan.

In the meantime, the intermediate transfer belt 20 (hereinafter referred to simply as "belt 20") is rotationally driven in the state of being tensed with a predetermined tension by the driving roll 21 and the tension rolls 22*a,* 22*b* and 22*c*. In addition, the belt 20 is tensed with a predetermined tension in the axial direction of each of the driving roll 21 and the tension rolls 22*a,* 22*b* and 22*c* so that the belt 20 is prevented from being biased in such axial direction. The toner image which is primarily transferred to the belt 20 moves with the rotation of the belt 20. During this time, the transfer roll 24 of the secondary transfer unit and the belt cleaner 25 are kept away from the belt 20 until the primary transfer of a final color (for example, cyan) is completed. Accordingly, when the black toner image primarily transferred to the belt 20 again reaches the primary transfer position, the next color toner image, for example, a yellow toner image, is primarily transferred to and superimposed on the black toner image. Subsequently, each time the toner image reaches the primary transfer position, the next toner image is superimposed on the previous toner image, so that the remaining toner images are superimposed in the order of magenta and cyan. After the final color toner image has been primarily transferred, the transfer roll 24 of the secondary transfer unit and the belt cleaner 25 are brought into abutment with the belt 20.

A recording sheet S which is accommodated in either of the recording-sheet-S trays 50*a* or 50*b* is transported to a position near a secondary transfer position by the pickup roll 51*a,* 51*b* and the transporting roll pairs 52*a* and 52*c* or by the pickup roll 51*b* and the transporting roll pairs 52*b* and 52*c,* and all the color toner images are superimposed on the belt 20 and when the nip of a register roll pair (not shown) is released at the timing when the superimposed color toner images reach the secondary transfer position, the recording sheet S is transported to the secondary transfer position. At the secondary transfer position, all the color toner images are secondarily transferred to the recording sheet S by the action of an electric field supplied from the transfer roll 24, and the resultant full color toner image is held on the surface of the recording sheet S. The recording sheet S is transported to the fixing unit 6 by the belt transporting unit 53, and while the recording sheet S is passing through the nip portion between the heating roll 60 and the pressure roll 61, the full color toner image is fixed to the recording sheet S by the action of heat and pressure, whereby a permanent image is formed and the image forming operation is completed.

It is to be noted that the image forming apparatus according to this embodiment is constructed so that the distance between the secondary transfer unit (the transfer section) and the fixing unit 6 (the fixing section) is longer than the maximum transporting-direction length of the recording sheet S on which an image can be formed. For example, the distance is set to be greater than the length (17 inches) of a sheet of maximum size so that an image can be formed on a sheet of 11" (inches)×17" (inches) larger than an A3 sheet. In addition, the image forming apparatus is provided with speed control means 3 for controlling a transporting speed $V_T$ of the belt transporting unit 53 (the transporting means) so that the transporting speed $V_T$ of the recording sheet S and a fixing speed $V_F$ thereof become approximately equal to each other at least when the leading edge of the recording sheet S reaches the fixing unit 6 (the fixing section).

Figure 3:
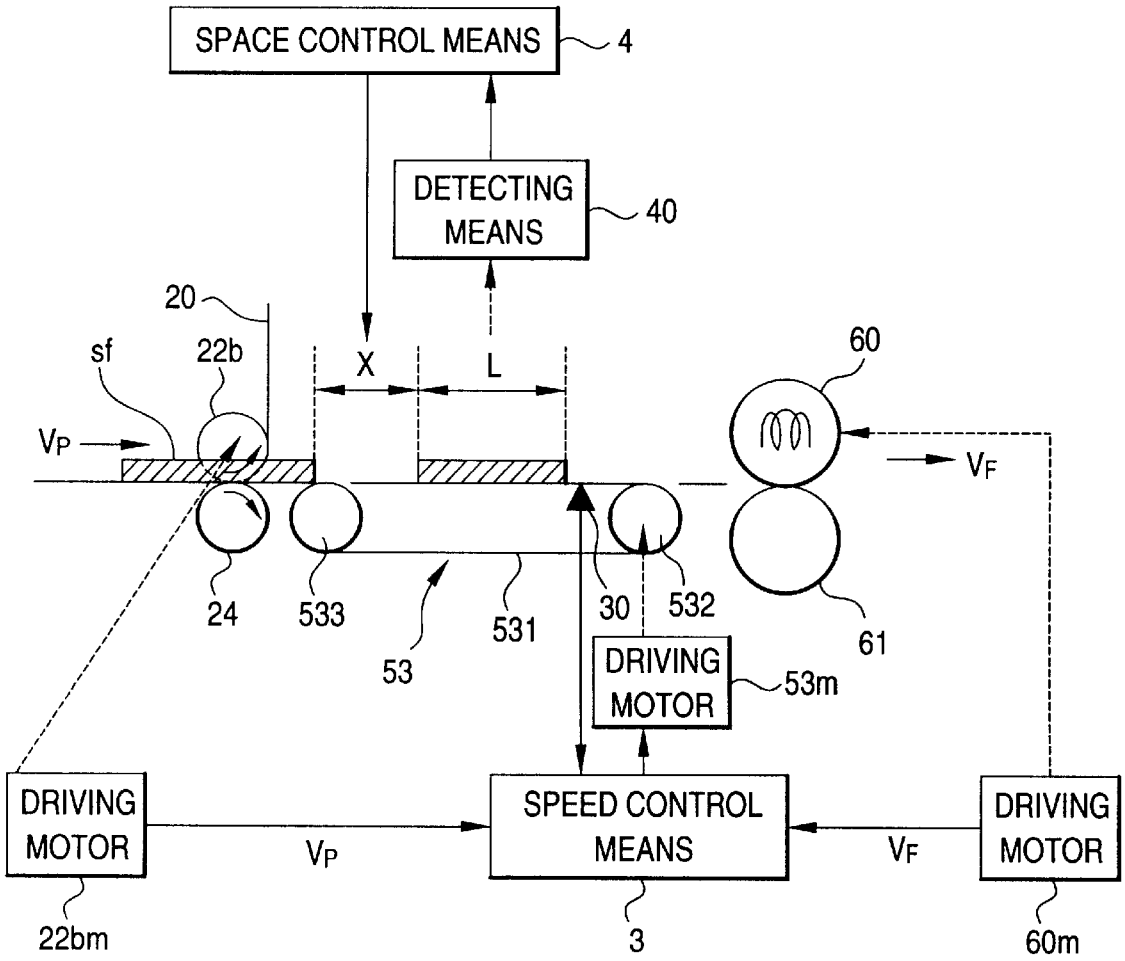
FIG. 3 is a block diagram illustrating a speed control system and a space control system according to Embodiment 1.

Specifically, as shown in FIG. 3, the image forming apparatus according to this embodiment is constructed so that the recording sheet S to which the toner image is transferred from the belt 20 by the secondary transfer unit (the transfer section) is transported to the fixing unit 5 (the fixing section) via the belt transporting unit 53 which serves as the transporting means. The belt transporting unit 53 includes an endless belt member 531 formed of an elastic material such as rubber or synthetic resin, a belt driving roller 532 for circularly driving the belt member 531, and an idle roller 533 which pairs with the belt driving roller 532 to support the endless belt member 531.

The belt driving roller 532 is rotationally driven by a driving motor 53*m* made of a stepping motor or the like, and the driving motor 53*m* is driven and controlled in response to a pulse signal outputted from a driving circuit (not shown) on the basis of a driving signal corresponding to a rotational speed outputted from the speed control means 3. The driving force of the driving motor 53*m* is transmitted to the belt driving roller 532 via a driving transmission mechanism (not show) such as gears and the belt driving roller 532 is rotationally driven to drive the endless belt member 531. The endless belt member 531 has a multiplicity of holes (not shown) for attracting a sheet, and is constructed to transport the recording sheet S to the fixing unit 6 with the recording sheet S being attracted to the transporting surface of the belt member 531 by an air suction unit (not show). In FIG. 3, reference numeral 22*bm* denotes a driving motor for rotationally driving the backup roll 22*b,* and reference numeral 60*m* denotes a driving motor for driving the fixing unit 6.

In addition, in the belt transporting unit 53, a sheet detecting sensor 30 for detecting the recording sheet S to be transported by the belt transporting unit 53 is disposed on the side of the belt driving roller 532, as shown in FIG. 3. The transporting speed $V_T$ of the belt transporting unit 53 can be varied by the speed control means 3 controlling the rotation of the driving motor 53*m* on the basis of signals supplied from the sheet detecting sensor 30, the driving motors 60*m* and 22*bm* and the like.

Furthermore, the image forming apparatus includes detecting means 40 for detecting the transporting-direction length of the recording sheet S, decision means 41 (not shown) for determining the kind of recording sheet, and space control means 4 for controlling a space X between the preceding recording sheet $S_p$ and the succeeding recording sheet $S_f$ according to a transporting-direction length L of the preceding recording sheet S and the kind of recording sheet S.

The detecting means 40 may be of a type which detects the transporting-direction length of the recording sheet S by detecting the size of the recording sheet S specified by a user or of a type which detects the transporting-direction length of the recording sheet S on the basis of the transporting speed of the recording sheet S and a signal indicative of the presence of the recording sheet S which is supplied from a sensor such as an arbitrary jam sensor which is present along the transporting path from the recording-sheet-S trays 50*a* and 50*b* to the secondary transfer unit. Otherwise, a sheet detecting sensor similar to the sheet detecting sensor 30 may be disposed on the side of the idle roller 533 in the belt transporting unit 53 to detect the transporting-direction length of the recording sheet S on the basis of the transporting speed $V_T$ of the recording sheet S and a signal indicative of the presence of the recording sheet S.

The space X between the preceding recording sheet $S_p$ and the succeeding recording sheet $S_f$ can be controlled by the space control means 4 in such a way that the space control means 4 changes, for example, the timing of writing of a latent image to the surface of the photoconductor drum 10 by the exposure unit 12 between continuous images on the basis of signals from the detecting means 40 and the like.

In addition, by changing the latent image writing timing in this manner, another xerographic process such as the opening/closing timing of the register rolls is changed in synchronism.

It is to be noted that in the present embodiment the speed control means 3 and the space control means 4 are stored in an auxiliary storage device (not shown) as control programs, and the function of each of the speed control means 3 and the space control means 4 is realized by these control programs being read into a primary storage and various processes based on the control programs being executed by a central processing unit.

In the image forming apparatus having the above-described construction according to the present embodiment, as will be described below, it is possible to compatibly realize maintenance of an optimum fixing speed according to the fixing characteristics of the recording sheet S and a reduction in the entire size of the apparatus as well as an improvement in the productivity of image formation, and it is also possible to reduce restrictions such as the size, transfer speed, fixing speed and transfer position of a recording medium to be used as well as the length and fixing position of a transporting unit.

Speed Control

A transfer step which is designed to transfer toner to a recording sheet S by an electrical action is comparatively rapidly executed, and a transfer speed $V_P$ is made equal to the rotational speed (process speed) of each of another belt 20 and the photoconductor drum 10. On the other hand, a fixing step which is designed to fuse and fix toner by the action of heat and pressure makes it necessary to adjust its fixing time according to the fixing characteristics of a recording sheet S or an toner image, therefore the fixing speed $V_F$ is in general made different from the transfer speed $V_P$. In an image forming apparatus which is provided with the fixing unit 6 which can realize the fixing speed $V_F$ approximately equal to the transfer speed $V_P$ of a reference recording sheet which is a recording sheet S of the type to be frequently used, if a recording sheet S which is inferior in fixing characteristics to the reference recording sheet S is to be used, the fixing speed $V_F$ must be lowered to ensure satisfactory fixing performance. In other words, if the process speed is increased to improve productivity while ensuring satisfactory fixing performance, a speed difference inevitably occurs between the transfer speed $V_P$ and the fixing speed $V_F$.

If the recording sheet S is transported at a constant speed $V_T(\cong V_P)$ approximately equal to the transfer speed $V_P$ by the belt transporting unit 53, it is true that the time required to transport the recording sheet S can be shortened, but when the leading edge of the recording sheet S reaches the fixing unit 6, a shock occurs due to the speed difference between the transporting speed $V_T(\cong V_P)$ and the fixing speed $V_F$ and, for example, an unfixed toner image on the recording sheet S is liable to be damaged. On the other hand, if the recording sheet S is transported at the constant speed $V_T(\cong V_P)$ approximately equal to the transfer speed $V_P$, it is true that when the leading edge of the recording sheet S reaches the fixing unit 6, no shock occurs and an unfixed toner image on the recording sheet S is not liable to be damaged, but a long time is taken to transport the recording sheet S and the productivity of image formation is impaired.

The present speed control for the transporting speed of the recording sheet S maintains the transporting speed at $V_T \cong V_P$ immediately before the leading edge of the recording sheet S reaches the fixing unit 6, and when the leading edge of the recording sheet S reaches the fixing unit 6, changes the transporting speed from $V_T \cong V_P$ to $V_T \cong V_F$ so that the transporting time of the recording sheet S can be made as short as possible to improve the productivity of image formation without causing a problem such as damage to a toner image on the recording sheet S. In addition, if such speed change control is reliably executed within a shorter time interval, the transporting path from the secondary transfer unit (the transfer section) to the fixing unit 6 (the fixing section) can be made shorter, whereby the entire size of the image forming apparatus can be made smaller.

Figure 4:
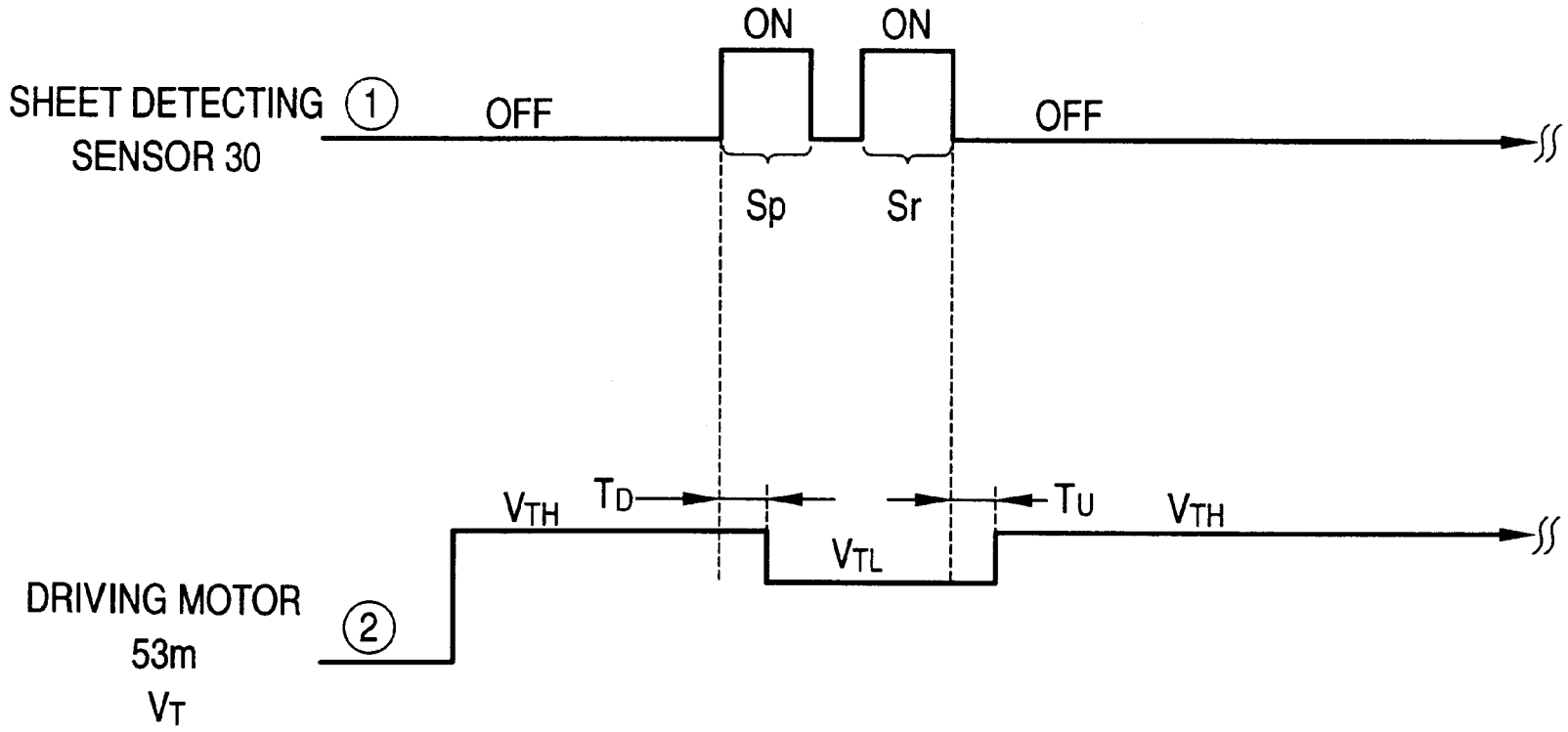
FIG. 4 is a timing chart illustrating the control timing of a transporting speed in the image forming apparatus according to Embodiment 1.

FIG. 4 shows timing charts illustrating one example of the above-described speed control. In a timing chart (1) of FIG. 4, the ON and OFF states of a signal supplied from the sheet detecting sensor 30 respectively indicate the presence and absence of a recording sheet S at a position where the sheet detecting sensor 30 is installed. In this example, two recording sheets S, i.e., the preceding-recording sheet $S_p$ and the succeeding recording sheet Sf, are continuously transported. A timing chart (2) of FIG. 4 shows a variation in the rotational speed of the driving motor 53*m*, i.e., the transporting speed $V_T$ of the recording sheet S during a transportation by the belt transporting unit 53. This transporting speed $V_T$ takes on three values of 0, $V_{TH}(\cong V_P)$ and $V_{TL}$ $(\cong V_F)$.

The initial value of the transporting speed $V_T$ is 0. Then, at the same time as, for example, the release of the nip of the register roll pair, the speed control means 3 changes the transporting speed $V_T$ from 0 to $V_{TH}$. Then, the leading edge of the preceding recording sheet $S_p$ is detected by the sheet detecting sensor 30, and when the speed control means 3 receives a detection signal from the sheet detecting sensor 30, the speed control means 3 activates a built-in software timer or the like and causes it to count time by $T_D$ [sec]. At the timing when the leading edge of the preceding recording sheet $S_p$ reaches a position immediately before the fixing nip portion of the fixing unit 6, the speed control means 3 outputs a control signal to the driving motor 53*m* so that the transporting speed $V_T$ is changed from $V_{TH}$ to $V_{TL}$, and the preceding recording sheet $S_p$ and the succeeding recording sheet $S_f$ are transported to the fixing unit 6 at the transporting speed $V_T$ approximately equal to the fixing speed $V_F$.

Then, when the speed control means 3 receives a signal indicating that the trailing edge of the succeeding recording sheet $S_f$ has passed the installation position of the sheet detecting sensor 30, the speed control means 3 causes the built-in software timer or the like to count time by $T_U$ [sec]. At the timing when the trailing edge of the succeeding recording sheet $S_f$ leaves the belt transporting unit 53, the speed control means 3 outputs a control signal to the driving motor 53*m* so that the transporting speed $V_T$ is changed from $V_{TL}$ to $V_{TH}$, and the speed control means 3 readies itself to transport the next recording sheet S at the transporting speed $V_T$ approximately equal to the transfer speed $V_P$.

Subsequently, the above-described operation is repeated. Incidentally, if the space X between the preceding recording sheet $S_p$ and the succeeding recording sheet $S_f$ is comparatively wide, the speed control means 3 changes the transporting speed $V_T$ from $V_{TL}$ to $V_{TH}$ when $T_U$ [sec] elapses after the trailing edge of the preceding recording sheet $S_p$ passes the installation position of the sheet detecting sensor 30. Then, when $T_U$ [sec] elapses after the leading edge of the succeeding recording sheet $S_f$ reaches the installation position of the sheet detecting sensor 30, the speed control means 3 changes the transporting speed $V_T$ from $V_{TH}$ to $V_{TL}$, and when $T_U$ [sec] elapses after the trailing edge of the succeeding recording sheet $S_f$ reaches the installation position of the sheet detecting sensor 30, the speed control means 3 changes the transporting speed $V_T$ from $V_{TL}$ to $V_{TH}$.

The transporting speeds $V_{TH}$ and $V_{TL}$ will be described below. Table 1 shows the fixing speed $V_F$ for each kind of recording sheet S. Table 2 shows the transporting speeds $V_{TH}$ and $V_{TL}$ for each kind of recording sheet S.

TABLE 1

| Kind of Recording Sheet | Fixing Speed $V_F$ |
|---|---|
| Plain Paper | $V_{F0}$ (= $\beta V_p$) |
| OHP Sheet | $V_{F1}$ |
| Very Thick Paper | $V_{F2}$ |
| Thick Paper | $V_{F3}$ |
| Thin Paper | $V_{F4}$ |

TABLE 2

| Kind of Recording Sheet | Transporting Speed $V_{TH}$ | Transporting Speed $V_\eta$ |
|---|---|---|
| Plain Paper | $V_{TH0}$ (= $\alpha V_p$) | $V_{TL0}$ (= $\alpha V_{F0}$) |
| OHP Sheet | $V_{TH1}$ (= $\gamma V_p$) | $V_{TL1}$ (= $\gamma V_{F1}$) |
| Very Thick Paper | $V_{TH2}$ (= $\gamma V_p$) | $V_{TL2}$ (= $\gamma V_{F2}$) |
| Thick Paper | $V_{TH3}$ (= $\gamma V_p$) | $V_{TL3}$ (= $\gamma V_{F3}$) |
| Thin Paper | $V_{TH4}$ (= $\gamma V_p$) | $V_{TL4}$ (= $\gamma V_{F4}$) |

In Tables 1 and 2, $\alpha$, $\beta$ and $\gamma$ are constants which take on values of, for example, approximately $0.90 \leqq \alpha, \beta, \gamma \leqq 1.10$.

As shown in Table 1, the fixing speed $V_F$ in the fixing unit 6 differs according to the kind of recording sheet S. This is because different kinds of recording sheets S differ in fixing characteristics according to their weights, materials or the like and also differ in the fixing time required to ensure satisfactory fixing performance. In other words, even if the materials of the recording sheets S are the same kind of paper, a recording sheet having a larger weight needs a longer fixing time and a slower fixing speed $V_F$. If the materials of the recording sheets S differ, their fixing speeds $V_F$ also differ. Incidentally, in Tables 1 and 2, $V_{F1}<V_{F2}<V_{F3}<V_{F0}<V_{F4}$ [mm/sec]. Control for changing the fixing speed $V_F$ according to the kind of recording sheet S is executed by a known control system (not shown).

As shown in Table 2, each of the transporting speeds $V_{TH}$ is obtained by multiplying the transfer speed $V_P$ by $\alpha$ predetermined one of the constants; that is to say, the transporting speed $V_{TH0}$ of plain paper is obtained by multiplying the transfer speed $V_P$ by $\alpha$, while each of the transporting speeds $V_{TH1}$ to $V_{TH4}$ of the other recording sheets S is obtained by multiplying the transfer speed $V_P$ by $\gamma$. Each of the transporting speeds $V_{TL}$ is obtained by multiplying the corresponding one of the fixing speeds $V_{P0}$ to $V_{F4}$ by a predetermined one of the constants; that is to say, the transporting speed $V_{TL0}$ of plain paper is obtained by multiplying the fixing speed $V_{F0}$ by a, while each of the transporting speeds $V_{TL1}$ to $V_{TL4}$ of the other recording sheets S is obtained by multiplying the corresponding one of the fixing speeds $V_{F1}$ to $V_{F4}$ by $\gamma$.

The speed control means 3 receives a signal indicative of the fixing speed $V_F$ from the driving motor 60*m* and determines the transporting speeds $V_{TH}$ and $V_{TL}$ according to the signal. For example, if the speed control means 3 receives a signal indicative of the fixing speed $V_{F3}$ from the driving motor 60*m*, the speed control means 3 uses the transporting speed $V_{TH3}$ and the transporting speed $V_{TL3}$ as the transporting speed $V_{TH}$ and the transporting speed $V_{TL}$ for the belt transporting unit 53, respectively. In this case, the respective transporting speeds $V_{TH3}$ and $V_{TL3}$ may also be obtained by multiplying the transfer speed $V_P$ and the fixing speed $V_{F3}$ outputted from the driving motors 22*bm* and 60*m* by $\gamma$. The speed control means 3 may be of a type which stores the transfer speeds shown in Table 2, in the form of a table in advance, and selects a set of appropriate transporting speed $V_{TH}$ and $V_{TL}$ from the stored table when receiving a signal indicative of the fixing speed $V_F$ from the driving motor 60*m*.

Space Control

As described previously, a speed difference occurs between the transfer speed $V_P$ and the fixing speed $V_F$. Therefore, in general, the space X between the preceding recording sheet $S_p$ and the succeeding recording sheet $S_f$ which are released from the secondary transfer unit (the transfer section) differs from a space Y between the preceding recording sheet $S_p$ and the succeeding recording sheet $S_f$ which are released from the fixing unit 6 (the fixing section). If the space X is made small, it is true that the productivity of image formation can be improved, but, for example if the fixing of the preceding recording sheet $S_p$ takes time, the trailing edge of the preceding recording sheet $S_p$ is liable to come into contact with the leading edge of the succeeding recording sheet Sf. On the other hand, if the space X is made large, it is true that there is no risk of contact between the adjacent recording sheets S, but the productivity of image formation is impaired.

Otherwise, consideration may be given to a method which assumes a worst case. Specifically, in this method, on the assumption that the preceding recording sheet $S_p$ is a recording sheet S of the type which requires longest fixing time and has a maximum transporting-direction length over which an image can be formed, a space $X_{MAX}$ which does not allow the succeeding recording sheet $S_f$ to come into contact with the trailing edge of the preceding recording sheet $S_p$ is calculated, and recording sheets S are continuously transported with each of the recording sheets S being spaced from the next one by the space $X_{MAX}$ at all times. However, such a worst case rarely occurs during actual image formation, and in many cases thereof, in terms of the productivity of image formation, it is not preferable to transport the recording sheets S with each of the recording sheets S being spaced from the next one by an unnecessary space $X_{MAX}$.

The present space control dynamically controls the recording-sheet space X so that the preceding recording sheet $S_p$ and the succeeding recording sheet $S_f$ can be prevented from colliding with each other during transportation and so that the productivity of image formation can be improved. In addition, the space control does not impose restrictions on layouts or the like in the image forming apparatus, because the recording-sheet space X is appropriately controlled on the basis of the transporting-direction length, transfer speed, fixing speed and transfer position of the preceding recording sheet $S_p$ as well as the length, fixing position and the like of a transporting unit.

One example of the above-described space control will be described below. Table 3 shows computation expressions for calculating the recording-sheet space X which are stored in the space control means 4.

TABLE 3

| Kind of $S_p$ | Computation Expression for Space X |
|---|---|
| Plain Paper | a0 + b0 × L |
| OHP Sheet | a1 + b1 × L |

TABLE 3-continued

| Kind of $S_p$ | Computation Expression for Space X |
|---|---|
| Very Thick Paper | a2 + b2 × L |
| Thick Paper | a3 + b3 × L |
| Thin Paper | a4 + b4 × L |

As shown in Table 3, the space control means 4 stores plural kinds (five kinds) of computation expressions according to the kind of preceding recording sheet Sp. In these expressions, L denotes the transporting-direction length of the preceding recording sheet $S_p$, and this transporting-direction length L is detected by the detecting means 40 and the detected information is transmitted to the space control means 4. In the above expressions, $a_0$ to $a_4$ and $b_0$ to $b_4$ are constants, and a method of obtaining these constants will be described later.

The space control means 4 selects an appropriate computation expression from among the stored plural kinds of computation expressions according to the kind of preceding recording sheet $S_p$, and substitutes the transporting-direction length L of the preceding recording sheet $S_p$ into the selected computation expression and obtains the space X between the preceding recording sheet $S_p$ and the succeeding recording sheet Sf, thereby controlling a xerographic process so that the space X is ensured. Thus, the succeeding recording sheet $S_f$ is actually transported in the state of being spaced from the preceding recording sheet $S_p$ by the space X. A well-known arbitrary technique can be applied to the space control in the xerographic process. For example, after the reference mark attached to the intermediate transfer belt 20 is detected by a reference sensor disposed in opposition to the intermediate transfer belt 20, the space control means 4 adjusts the start timing of each xerographic process and realizes the space X between the preceding recording sheet $S_p$ and the succeeding recording sheet $S_f$ while retaining the matching between the space between toner images to be formed on the intermediate transfer belt 20 and a recording-sheet space to be adjusted by the register roll pair.

For example, if the preceding recording sheet $S_p$ is an OHP sheet and its transporting-direction length is 210 mm, the space control means 4 selects $X=a_1+b_1\times L$ as a computation expression and substitutes 210 for L to obtain $X=a_1+b_1\times 210$ as the space X between the preceding recording sheet $S_p$ and the succeeding recording sheet Sf, and executes control based on the obtained space X. Incidentally, a decision as to the kind of preceding recording sheet $S_p$ is made by the decision means 41 (not shown) determining the kind of recording sheet S which is inputted via an user interface such as a touch panel by a user before formation of an image. Information indicative of the kind of recording sheet S is transmitted from the decision means 41 (not shown) to the space control means 4.

If the decision means 41 (not shown) is a sheet thickness sensor or a sheet resistance sensor which is disposed in the vicinity of the transporting path for the recording sheet, the kind of recording sheet S can be determined on the basis of sheet thickness information or sheet resistance information supplied from the sheet thickness sensor or the sheet resistance sensor. In addition, if the decision means 41 (not shown) can receive in advance a signal indicative of the fixing speed $V_F$ of the recording sheet S from, for example, the driving motor 60*m* or a control system (not shown) for the fixing speed $V_F$ (refer to FIG. 3), the decision means 41 (not shown) can determine the kind of recording sheet S from the fixing speed $V_F$ (refer to Table 1).

The constants $a_0$ to $a_4$ and $b_0$ to $b_4$ are determined so that the preceding recording sheet $S_p$ and the succeeding recording sheet $S_f$ can be prevented from colliding with each other during transportation and so that the productivity of image formation can be improved. By way of example, the following description will refer to a method of obtaining the constants $a_0$ to $a_4$ and $b_0$ to $b_4$ on the condition that if the leading edge of the succeeding recording sheet $S_f$ reaches the sheet detecting sensor 30, the preceding recording sheet $S_p$ has passed through the nip portion in the fixing unit 6 (this condition will be hereinafter referred to as the condition (1)).

Figure 5:
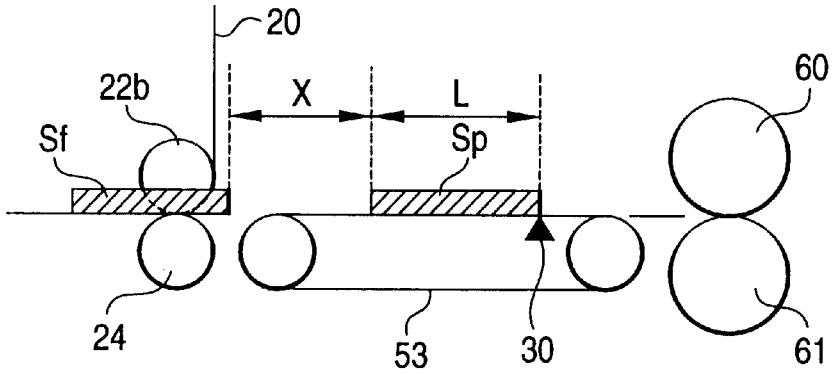
FIGS. 5(*a*), 5(*b*) and 5(*c*) are views illustrating a variation in positional relationship from a secondary transfer unit to a fixing unit.
Figure 5:
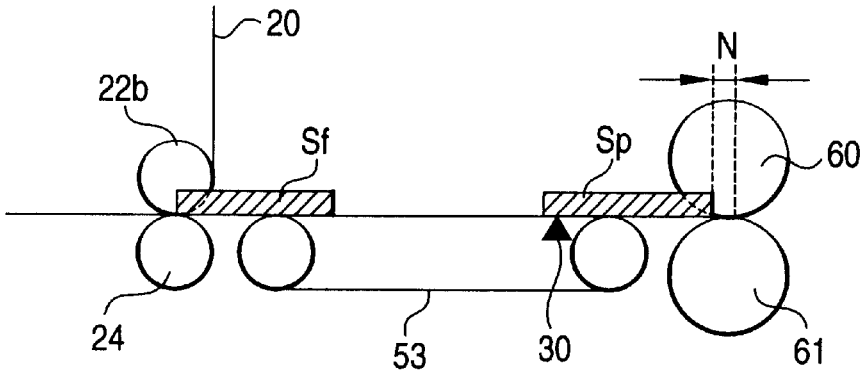
Figure 5:
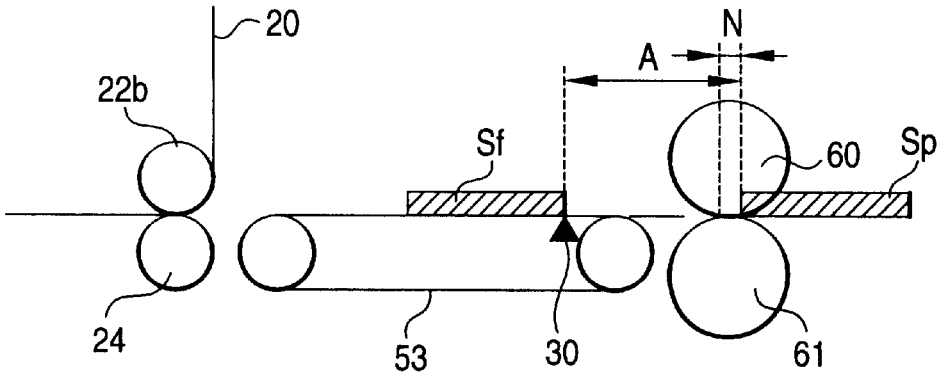

FIGS. 5(*a*) to 5(*c*) are views illustrating the positional relationship between the secondary transfer unit (the transfer section), the fixing unit 6 (the fixing section), the belt transporting unit 53 (the transporting means) and the recording sheet S in the present embodiment, and a temporal variation in the positional relationship is shown throughout FIGS. 5(*a*) to 5(*c*).

FIG. 5(*a*) shows the state in which the leading edge of the preceding recording sheet $S_p$ as reached the installation position of the sheet detecting sensor 30. In FIG. 5(*a*), L denotes the transporting-direction length of the preceding recording sheet $S_p$, and X denotes the space between the preceding recording sheet $S_p$ and the succeeding recording sheet Sf. FIG. 5(*b*) shows the state in which the leading edge of the preceding recording sheet $S_p$ has reached a nip portion N between the heating roll 60 and the pressure roll 61 in the fixing unit 6. FIG. 5(*c*) shows the state in which the trailing edge of the preceding recording sheet $S_p$ has passed through the nip portion N and the leading edge of the succeeding recording sheet $S_f$ has reached the installation position of the sheet detecting sensor 30. In FIG. 5(*c*), A denotes the distance from the installation position of the sheet detecting sensor 30 to the end of the nip portion N.

Expression 1

$$t_1=(A-N)\div V_{TL} \tag{1}$$

$$\Delta X_1=t_1\times(\alpha V_P-V_{TL})$$

$$=(A-N)\div V_{TL}\times(\alpha V_P-V_{TL}) \tag{2}$$

Letting $t_1$ be the time required for the positional relationship to change from the state shown in FIG. 5(*a*) to the state shown in FIG. 5(*b*), $t_1$ can be expressed as Expression (1), where A−N represents the transporting distance of the preceding recording sheet $S_p$ and represents the transporting speed of the preceding recording sheet Sp. In addition, letting $\Delta X_1$ be the space between the preceding recording sheet $S_p$ and the succeeding recording sheet Sf, which space $\Delta X_1$ becomes narrower during $t_1$, $\Delta X_1$ can be expressed as Expression (2) because, during $t_1$, the preceding recording sheet $S_p$ is transported at the transporting speed $V_{TL}$ and the succeeding recording sheet $S_f$ is transported at the transporting speed $\alpha V_P$ (assuming that the succeeding recording sheet $S_f$ is plain paper).

Expression 1

$$t_2=(N+L)\div V_F \tag{3}$$

$$\Delta X_2=t_2\times(\alpha V_P-V_F)$$

$$=(N+L)\div V_F\times(\alpha V_P-V_{TL}) \tag{4}$$

Letting $t_2$ be the time required for the positional relationship to change from the state shown in FIG. 5(*b*) to the state shown in FIG. 5(*c*), $t_2$ can be expressed as Expression (3), where N+L represents the transporting distance of the preceding recording sheet $S_p$ and $V_F$ represents the transporting speed of the preceding recording sheet Sp. In addition, letting $\Delta X_2$ be the space between the preceding recording sheet $S_p$ and the succeeding recording sheet Sf, which space $\Delta X_2$ becomes narrower during $t_2$, $\Delta X_2$ can be expressed as Expression (4) because, during $t_2$, the preceding recording sheet $S_p$ is transported at the transporting speed $V_F$ and the succeeding recording sheet $S_f$ is transported at the transporting speed $\alpha V_P$ (assuming that the succeeding recording sheet $S_f$ is plain paper).

Expression 3

$$X-\Delta X_1-\Delta X_2 \geqq A \tag{5}$$

To meet the above-described condition (1), even if the space X which is given as an initial value becomes narrow during transportation, the space X needs to be not less than A. Therefore, the condition (1) is expressed as Expression (5).

Expression 4

$$X \geqq A+(\alpha/\beta-1)\times N+(\alpha/\beta-1)\times L \tag{6}$$

$$X \geqq [\{A+(\gamma-1)\times N\}/\gamma]\times(\alpha V_P/V_{F1})+(\alpha V_P/V_{F1}-1)\times L \tag{7}$$

$$X \geqq [\{A+(\gamma-1)\times N\}/\gamma]\times(\alpha V_P/V_{F2})+(\alpha V_P/V_{F2}-1)\times L \tag{8}$$

$$X \geqq [\{A+(\gamma-1)\times N\}/\gamma]\times(\alpha V_P/V_{F3})+(\alpha V_P/V_{F3}-1)\times L \tag{9}$$

$$X \geqq [\{A+(\gamma-1)\times N\}/\gamma]\times(\alpha V_P/V_{F4})+(\alpha V_P/V_{F4}-1)\times L \tag{10}$$

By substituting into Expression (5) the fixing speed $V_F$ and the transporting speed $V_{TL}$ according to each of the kinds of recording sheets S shown in Tables 1 and 2, Expressions (6) to (10) are obtained. For example, Expression (7) gives the range of the space X which satisfies the condition (1) if the preceding recording sheet $S_p$ is an OHP sheet.

Figure 6:
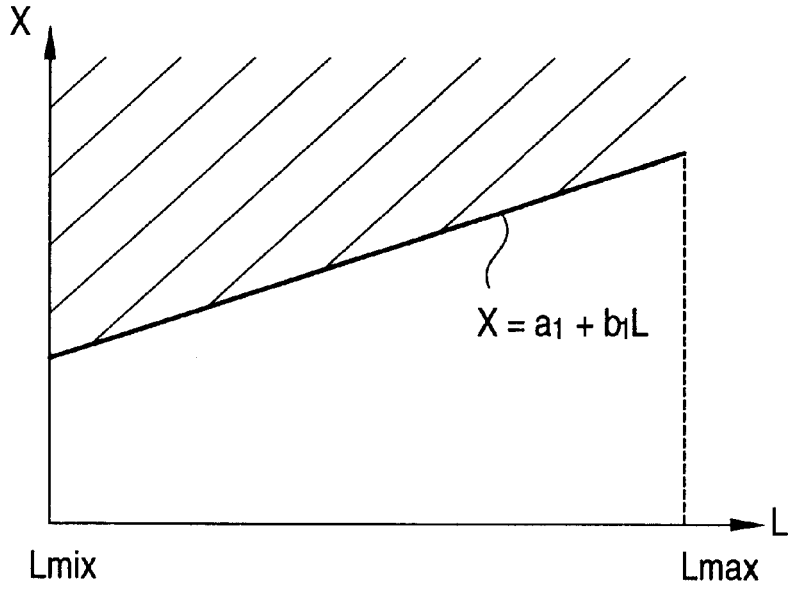
FIG. 6 is a graph showing the range of a space X to be formed between recording sheets if the preceding recording sheet $S_p$ is an OHP sheet.

FIG. 6 is a graph representing as an shaded portion the range of the space X which satisfies the condition (1) if the preceding recording sheet $S_p$ is an OHP sheet. In this graph, the horizontal axis represents the transporting-direction length L of the preceding recording sheet $S_p$, while the vertical axis represents the recording-sheet space X, and $L_{min}$ on the horizontal axis denotes the minimum usable transporting-direction size of the recording sheet S, while $L_{MAX}$ denotes the maximum usable transporting-direction size of the recording sheet S. If the range of the space X is in the shaded portion of this graph, the range of the space X satisfies the condition (1). To improve the productivity of image formation, it is preferable to make the space X as narrow as possible. For this reason, the space control means 4 stores an expression obtained by replacing the inequality sign of Expression (7) with an equality sign.

For example, $a_1$ and $b_1$ in the computation expression $$(X=a_1+b_1\times L)$$

for calculating the space X if the kind of preceding recording sheet $S_p$ stored in the space control means 4 is an OHP sheet are $$a_1=[\{A+(\gamma-1)\times N\}/\gamma]\times\alpha\times V_P\div V_{F1}$$

and $$b_1=(a\times V_P\div V_{F1})-1,$$

respectively. Similarly, the space control means 4 stores computation expressions for calculating the spaces X relative to the other kinds of preceding recording sheets $S_p$, i.e., an expression which is similar to Expression (6) except that the inequality sign thereof is replaced with an equality sign and which is used to calculate the space X if the preceding recording sheet $S_p$ is plain paper, an expression which is similar to Expression (8) except that the inequality sign thereof is replaced with an equality sign and which is used to calculate the space X if the preceding recording sheet $S_p$ is very thick paper, an expression which is similar to Expression (9) except that the inequality sign thereof is replaced with an equality sign and which is used to calculate the space X if the preceding recording sheet $S_p$ is thick paper, and an expression which is similar to Expression (10) except that the inequality sign thereof is replaced with an equality sign and which is used to calculate the space X if the preceding recording sheet $S_p$ is thin paper.

Figure 7:
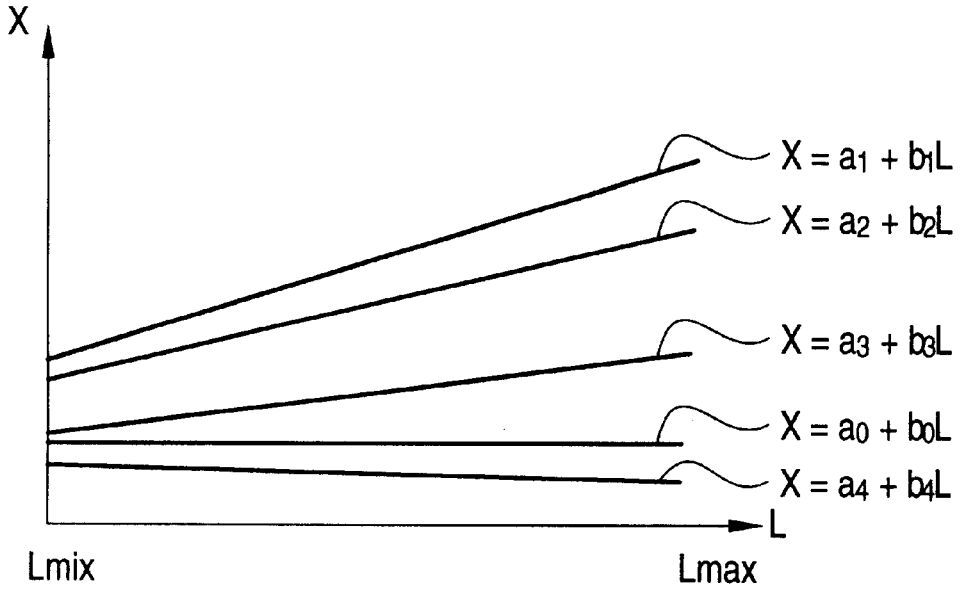
FIG. 7 is a graph showing computation expressions for calculating the spaces X according to the respective kinds of preceding recording sheets $S_p$.

FIG. 7 is a graph showing the computation expressions for calculating the spaces X according to the respective kinds of recording sheets S stored in the space control means 4. It is seen from this graph that a space X which is as narrow as possible and can satisfy the above-described condition (1) can be obtained on the basis of the kind of preceding recording sheet $S_p$ and the transporting-direction length L thereof. In addition, as can be seen from FIG. 7, if the kind of preceding recording sheet $S_p$ is an OHP sheet, very thick paper or thick paper, the corresponding computation expression draws a straight line candidate of a monotonous increase having any one of different inclinations which become larger in the order of OHP sheet, very thick paper and thick paper, and these kinds of recording sheets S need more fixing time in that order (because their fixing speeds $V_F$ are slower in that order). Accordingly, they need wider spaces X in that order to satisfy the above-described condition (1). In addition, as can be seen from FIG. 7, if the kind of recording sheet S is plain paper, the inclination of the straight light drawn by the corresponding computation expression is approximately zero, and in the image forming apparatus, there is almost no difference between the transfer speed $V_P$ and the fixing speed $V_{F0}$ for plain paper. Furthermore, it can be seen that in the case of thin paper, the corresponding computation expression draws a straight line candidate of a monotonous decrease so that the preceding recording sheet $S_p$ can be transported with a space X which is made narrower while the above-described condition (1) is satisfied.

Modification

In the space control of Embodiment 1, the constants $a_0$ to $a_4$ and $b_0$ to $b_4$ are obtained on the assumption that the succeeding recording sheet $S_f$ is plain paper. However, in the case of actual image formation, the succeeding recording sheet $S_f$ may be of a kind other than plain paper, for example, an OHP sheet or thick paper.

In the present modification, the space control means 4 stores plural kinds of computation expressions which give not only a space X corresponding to the kind of preceding recording sheet $S_p$ but also a space X corresponding to the kind of succeeding recording sheet Sf. The space control means 4 selects appropriate computation expressions from among the stored plural kinds of computation expressions according to the kind of preceding recording sheet $S_p$ and the kind of succeeding recording sheet Sf, and substitutes the transporting-direction length L of the preceding recording sheet $S_p$ into each of the selected computation expressions and obtains the space X between the preceding recording sheet $S_p$ and the succeeding recording sheet Sf, thereby controlling a xerographic process so that the space X is ensured. Thus, the succeeding recording sheet $S_f$ is actually transported in the state of being spaced from the preceding recording sheet $S_p$ by the space X.

One example of the above-described space control will be described below. Table 4 shows computation expressions for calculating the recording-sheet spaces X which are stored in the space control means 4. In this example, the space control means 4 stores different computation expressions according to whether the kind of succeeding recording sheet $S_f$ is plain paper or other than plain paper.

TABLE 4

| | Computation Expression for Space X | |
|---|---|---|
| Kind of $S_p$ | $S^f$: Plain Paper | $S^f$: Other Than Plain Paper |
| Plain Paper | a0 + b0 × L | a0' + b0' × L |
| OHP Sheet | a1 + b1 × L | a1' + b1' × L |
| Very Thick Paper | a2 + b2 × L | a2' + b2' × L |
| Thick Paper | a3 + b3 × L | a3' + b3' × L |
| Thin Paper | a4 + b4 × L | a4' + b4' × L |

For example, if the preceding recording sheet $S_p$ is an OHP sheet and its transporting-direction length is 210 mm and the succeeding recording sheet $S_f$ is thick paper (other than plain paper), the space control means 4 selects $$X=a_1'+b_1'\times L$$

as a computation expression and substitutes 210 for L to obtain $$X=a_1'+b_1'\times 210$$

as the space X between the preceding recording sheet $S_p$ and the succeeding recording sheet Sf, and executes control based on the obtained space X. Incidentally, decisions as to the kind of preceding recording sheet $S_p$ and the kind of succeeding recording sheet $S_f$ can be made in a manner similar to that described previously in connection with Embodiment 1.

A method of obtaining the constants $a_0'$ to $a_4'$ and $b_0'$ to $b_4'$ to satisfy the above-described condition (1) will be described below.

Expressions (1) to (5) are used for obtaining the constants $a_0$ to $a_4$ and $b_0$ to $b_4$, and among Expressions (1) to (5), the portions of Expressions (2) and (4) which are marked with wavy underlines are related to the kind of succeeding recording sheet Sf. Each of these portions marked with wavy underlines means the transporting speed $V_{TH}$ of the succeeding recording sheet Sf, and in Expressions (2) and (4), since it is assumed that the kind of succeeding recording sheet $S_f$ is plain paper, the transporting speed $V_{TH}$ is calculated as $\alpha\times V_P$. Therefore, the transporting speed $V_{TH}$ of each of the portions marked with wavy underlines can be changed according to the kind of succeeding recording sheet Sf, and the constants $a_0'$ to $a_4'$ and $b_0'$ to $b_4'$ can be obtained in a manner similar to that described previously in connection with Embodiment 1. If the kind of succeeding recording sheet $S_f$ is other than plain paper, the transporting speed $V_{TH}$ is a constant value of $\gamma\times V_P$ (refer to Table 2). Accordingly, if $\gamma\times V_P$ is substituted for $a\times V_P$ in each of the portions marked with wavy underlines in Expressions (2) and (4), the constants $a_0'$ to $a_4'$ and $b_0'$ to $b_4'$ can be obtained in a manner similar to that described previously in connection with Embodiment 1.

In this embodiment, there are only two kinds of transporting speeds $V_{TH}$ of recording sheets S, i.e., $\alpha\times V_P$ for plain paper and $\gamma\times V_P$ for the kinds other than plain paper (refer to Table 2). Therefore, in this modification as well, since the kinds of succeeding recording sheets $S_f$ are plain paper and other than plain paper and five kinds of preceding recording sheets $S_p$ are usable, the space control means 4 stores only ten kinds of spaces X (2×5) in total. However, for example, if five kinds of transporting speeds $V_{TH}$ of recording sheets S are present for the respective kinds of recording sheets S, the space control means 4 may store computation expressions for calculating five different spaces X for the respective five kinds of succeeding recording sheets $S_f$ and five different spaces X for the respective five kinds of preceding recording sheets $S_p$, a total of twenty-five kinds of spaces X (5×5).

Embodiment 2

Figure 8:
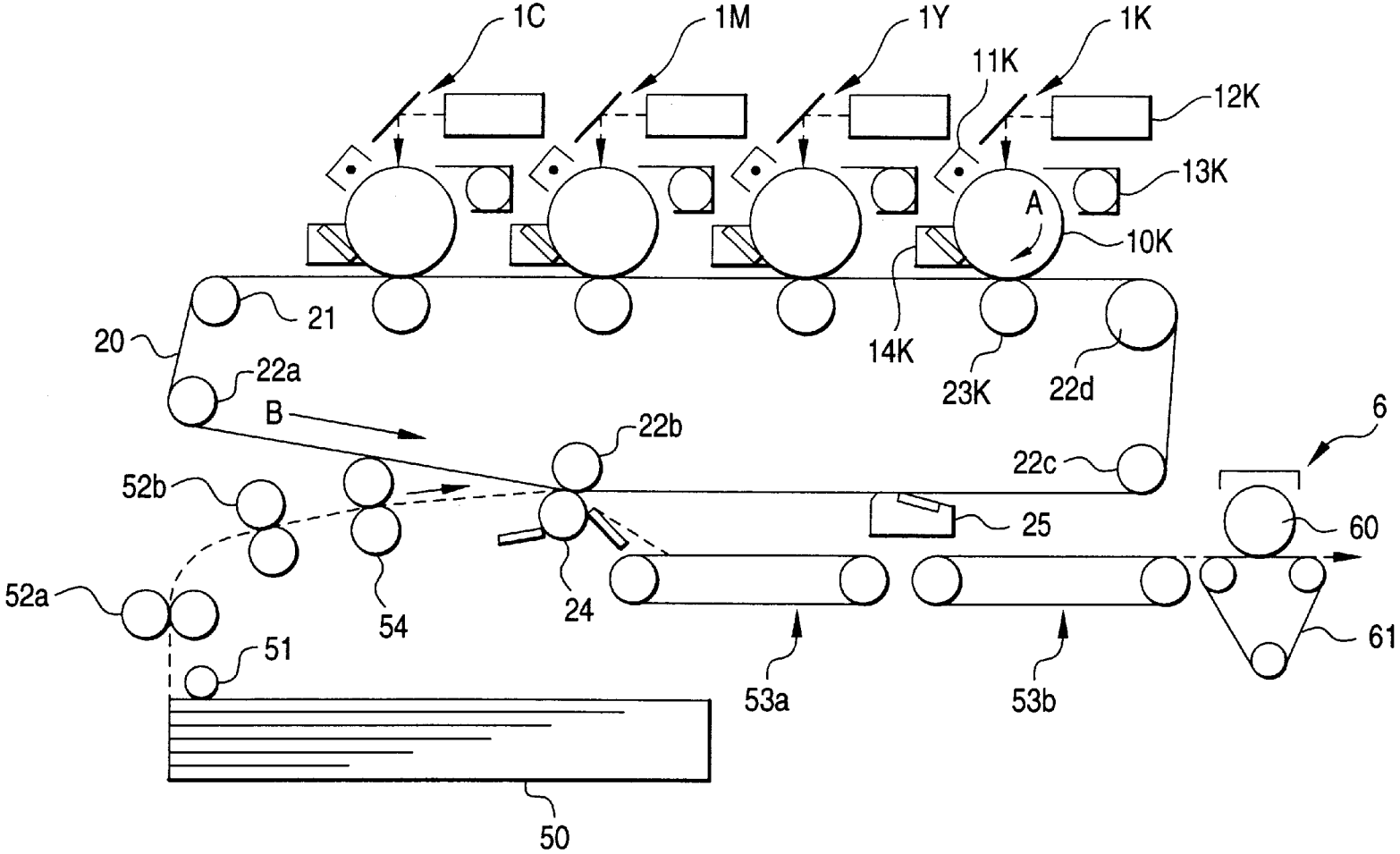
FIG. 8 is a view illustrating the construction of an image forming apparatus according to Embodiment 2.

FIG. 8 shows the construction of an image forming apparatus (color printer) according to the present embodiment. In the shown image forming apparatus, four image forming sections 1 (1K, 1Y, 1M and 1C) are sequentially arranged along the intermediate transfer belt 20, and toner images of color components (black, yellow, magenta and cyan) are respectively formed by the image forming sections 1 (1K, 1Y, 1M and 1C) and are temporarily transferred to the intermediate transfer belt 20 in such a manner that they are sequentially superimposed on one another, thereby enabling formation of a full color image. In the image forming apparatus, the transfer roll 23 is used as a temporary transfer unit and the belt pressure assembly 61 is used as a pressure rotary part of the fixing unit 6. The other constituent elements which are common to the image forming apparatus according to Embodiment 1 are denoted by identical reference numerals, and the description of such constituent elements is omitted.

The operation of forming a full color image in the image forming apparatus according to Embodiment 2 differs from the operation of forming a full color image in the image forming apparatus according to Embodiment 1 in that toner images of the respective color components are separately formed by the image forming sections 1K, 1Y, 1M and 1C and are sequentially transferred at temporary transfer positions in the respective image forming sections 1K, 1Y, 1M and 1C. However, the other operations of Embodiment 2 are similar to those of Embodiment 1, and the description of the other operations is omitted.

It is to be noted that the image forming apparatus according to this embodiment is constructed so that the distance between the secondary transfer unit (the transfer section) and the fixing unit 6 (the fixing section) is longer than the maximum transporting-direction length of a recording sheet S on which an image can be formed. For example, the distance is set to be greater than the length (17 inches) of a sheet 13 of maximum size so that an image can be formed on a sheet of 11" (inches)×17" (inches) larger than an A3 sheet. In addition, the image forming apparatus is provided with the speed control means 3 for controlling a transporting speed $V_T$ of the belt transporting unit 53 (the transporting means) so that the transporting speed $V_T$ and the fixing speed $V_F$ of the recording sheet S become approximately equal to each other at least when the leading edge of the recording sheet S reaches the fixing unit 6 (the fixing section).

Figure 9:
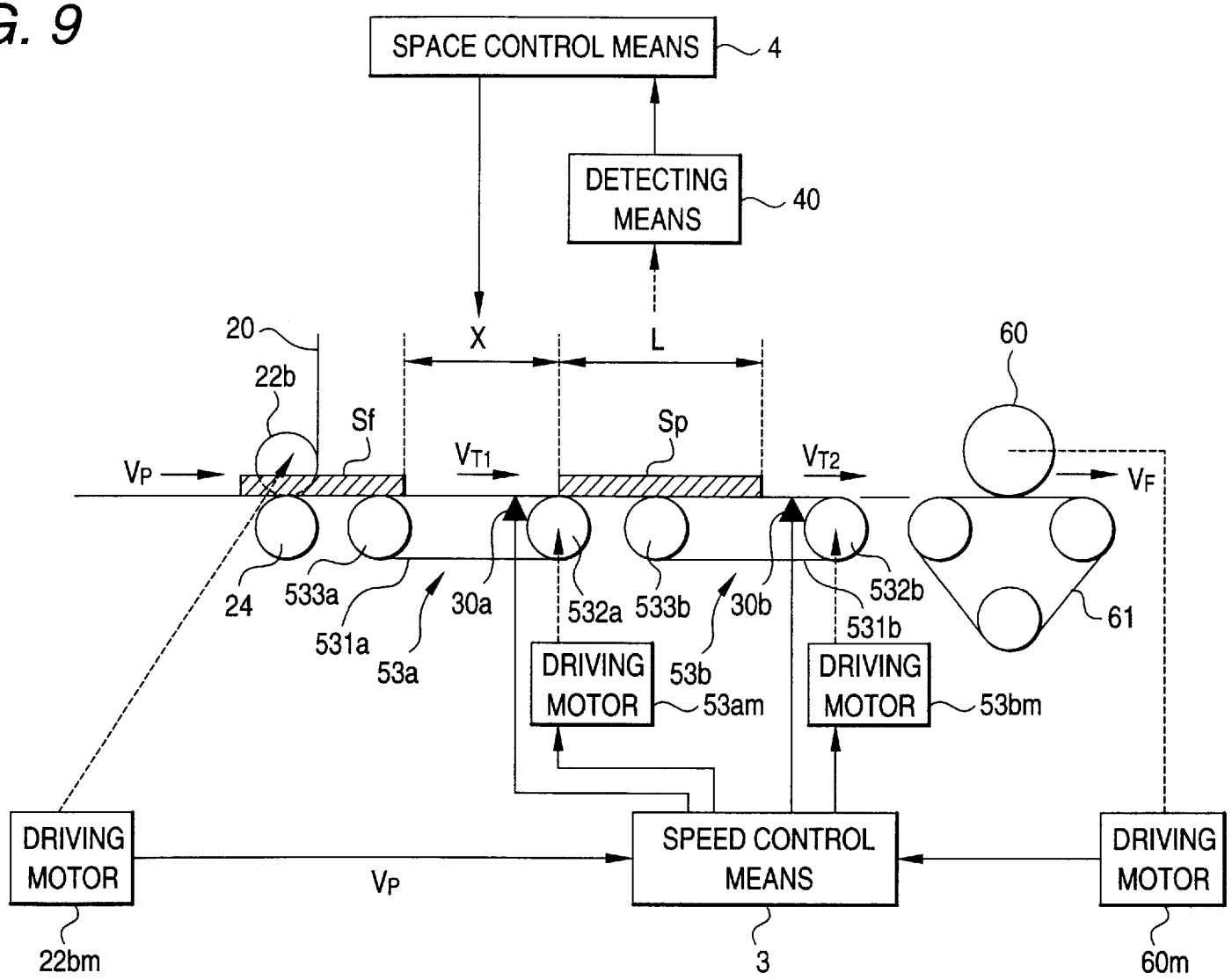
FIG. 9 is a block diagram illustrating a speed control system and a space control system according to Embodiment 2.

Specifically, as shown in FIG. 9, the image forming apparatus according to this embodiment is constructed so that the recording sheet S to which the toner image is transferred from a belt 201 by the secondary transfer unit (the transfer section) is transported to the fixing unit 6 (the fixing section) via first and second belt transporting units 53*a* and 53*b* which serve as the transporting means.

The first and second belt transporting units 53*a* and 53*b* respectively include endless belt members 531*a* and 531*b* each formed of an elastic material such as rubber or synthetic resin, belt driving rollers 532*a* and 532*b* for circularly driving the belt members 531*a* and 531*b*, and idle rollers 533*a* and 533*b* which pair with the belt driving rollers 532*a* and 532*b* to support the endless belt members 531*a* and 531*a*.

The respective belt driving rollers 532*a* and 532*b* are rotationally driven independently of each other by driving motor 53*ma* and 53*mb* each made of a stepping motor or the like, and the respective driving motors 53*ma* and 53*mb* are driven and controlled in response to pulse signals outputted from driving circuits (not shown) on the basis of driving signals corresponding to rotational speeds independent of each other, which are outputted from the speed control means 3. The driving forces of the respective driving motors 53*ma* and 53*mb* are transmitted to the belt driving rollers 532*a* and 532*b* via driving transmission mechanisms (not show) such as gears and the respective belt driving rollers 532*a* and 532*b* are rotationally driven to drive the endless belt members 531*a* and 531*b*. Each of the endless belt members 531*a* and 531*b* has a multiplicity of holes (not shown) for attracting a sheet, and is constructed to transport the recording sheet S to the fixing unit 6 with the recording sheet S being attracted to the transporting surface of the belt member 531 by an air suction unit (not show). In FIG. 9, reference numeral 22*bm* denotes a driving motor for rotationally driving the backup roll 22*b*, and reference numeral 60*m* denotes a driving motor for driving the fixing unit 6.

In addition, in the first and second belt transporting units 53*a* and 53*b*, sheet detecting sensors 30*a* and 30*b* for detecting the recording sheet S to be transported by the belt transporting units 53*a* and 53*b* are respectively disposed on the sides of the belt driving rollers 532*a* and 532*b* in each of the belt transporting units 53*a* and 53*b*, as shown in FIG. 9. The respective transporting speeds $V_T$ of the first and second belt transporting units 53*a* and 53*b* can be varied by the speed control means 3 independently controlling the rotations of the driving motors 53*ma* and 53*mb* on the basis of signals supplied from the sheet detecting sensors 30*a* and 30*b*, the driving motors 60*m* and 22*bm* and the like.

Furthermore, the image forming apparatus includes detecting means 40 for detecting the transporting-direction length of the recording sheet S, decision means 41 (not shown) for determining the kind of recording sheet, and the space control means 4 for controlling the space X between the preceding recording sheet $S_p$ and the succeeding recording sheet $S_f$ according to the transporting-direction length L of the preceding recording sheet S and the kind of recording sheet S.

The detecting means 40 may be of a type which detects the transporting-direction length of the recording sheet S by detecting the size of the recording sheet S specified by a user or of a type which detects the transporting-direction length of the recording sheet S on the basis of the transporting speed of the recording sheet S and a signal indicative of the presence of the recording sheet S which is supplied from a sensor such as an arbitrary jam sensor which is present along the transporting path from a recording-sheet-S tray 50 to the secondary transfer unit. Otherwise, a sheet detecting sensor similar to the sheet detecting sensor 30 may be disposed on the side of the idle roller 533*a* in the first belt transporting unit 53*a* to detect the transporting-direction length of the recording sheet S on the basis of the transporting speed $V_T$ of the recording sheet S and a signal indicative of the presence of the recording sheet S.

The space X between the preceding recording sheet $S_p$ and the succeeding recording sheet $S_f$ can be controlled by the space control means 4 in such a way that the space control means 4 changes, for example, the timing of writing of a latent image to the surface of the photoconductor drum 10 by the exposure unit 12 between continuous images on the basis of signals from the detecting means 40 and the like. In addition, by changing the latent image writing timing in this manner, another xerographic process such as the opening/closing timing of the register rolls is changed in synchronism.

It is to be noted that in the present embodiment the speed control means 3 and the space control means 4 are stored in an auxiliary storage device (not shown) as control programs, and the function of each of the speed control means 3 and the space control means 4 is realized by these control programs being read into a primary storage and various processes based on the control programs being executed by a central processing unit.

In the image forming apparatus having the above-described construction according to the present embodiment, as will be described below, it is possible to compatibly realize maintenance of an optimum fixing speed according to the fixing characteristics of the recording sheet S and a reduction in the entire size of the apparatus as well as an improvement in the productivity of image formation, and it is also possible to reduce restrictions such as the size, transfer speed, fixing speed and transfer position of a recording medium to be used as well as the length and fixing position of a transporting unit.

Speed Control

A speed control for the transporting speed of the recording sheet S is similar to the speed control performed in Embodiment 1 in that the speed control maintains the transporting speed at $V_T \cong V_P$ immediately before the leading edge of the recording sheet S reaches the fixing unit 6, and when the leading edge of the recording sheet S reaches the fixing unit 6, changes the transporting speed from $V_T \cong V_P$ to $V_T \cong V_F$ so that the transporting time of the recording sheet S can be made as short as possible to improve the productivity of image formation without causing damage to a toner image on the recording sheet S. Furthermore, in the present embodiment, when the transporting means includes a plurality of (two) belt transporting units 53*a* and 53*b*, and the speed control means 3 independently controls the transfer speeds of the respective belt transporting units 53*a* and 53*b*, it is possible to improve the productivity of image formation to a further extent.

Specifically, while recording sheets S are being continuously transported, if the preceding recording sheet $S_p$ is being transported by only the belt transporting unit 53*b* which is disposed on a downstream side in the transporting direction, the transporting speed of only the belt transporting unit 53*b* needs only to be changed from $V_T \cong V_P$ to $V_T \cong V_F$ when the leading edge of the preceding recording sheet $S_p$ reaches the fixing unit 6, whereby the transporting speed of the belt transporting unit 53*a* on an upstream side in the transporting direction can be held at $V_T \cong V_F$. Consequently, the succeeding recording sheet $S_f$ can be rapidly transported.

Figure 10:
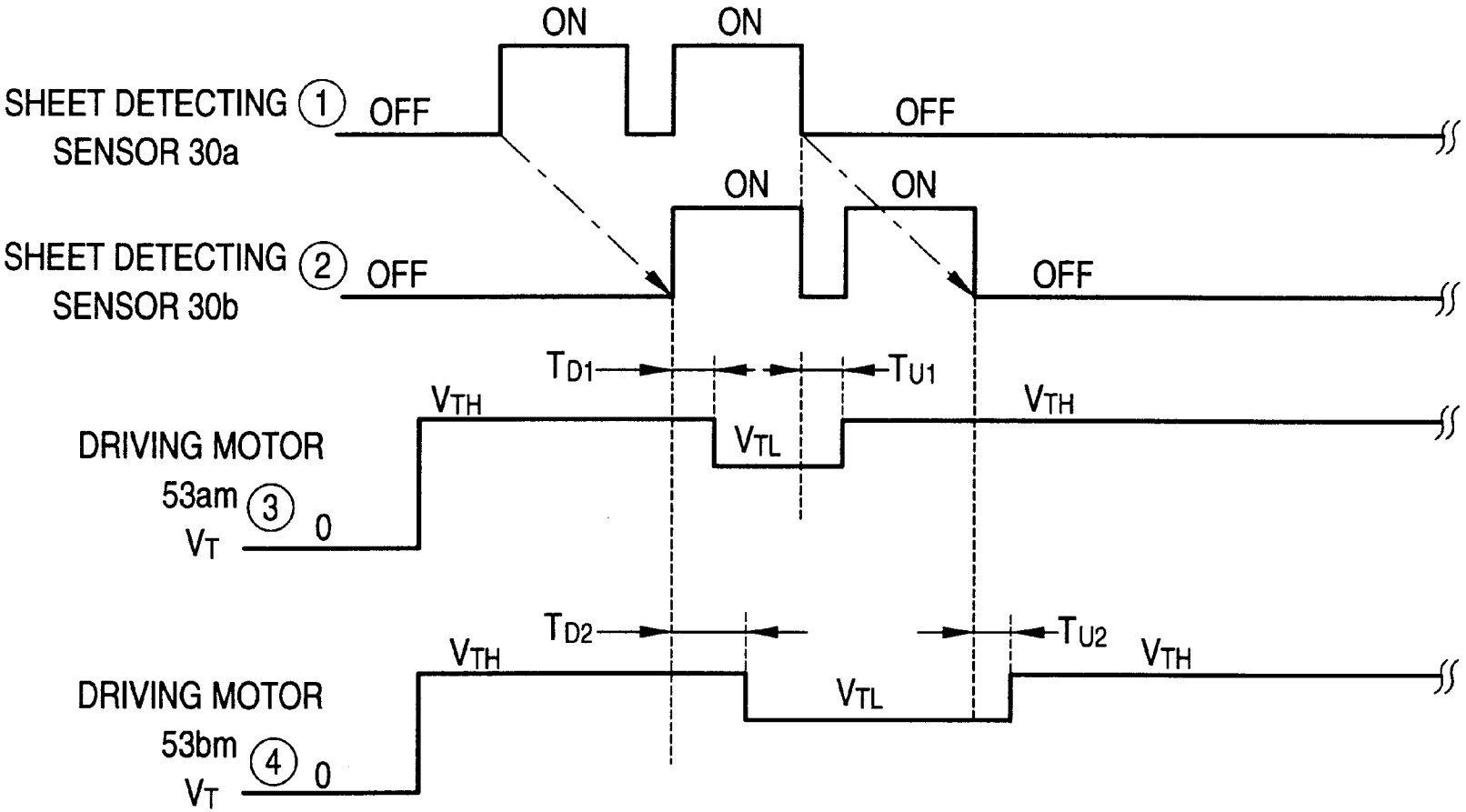
FIG. 10 is a timing chart illustrating the control timing of a transporting speed in the image forming apparatus according to Embodiment 2.
Figure 11:
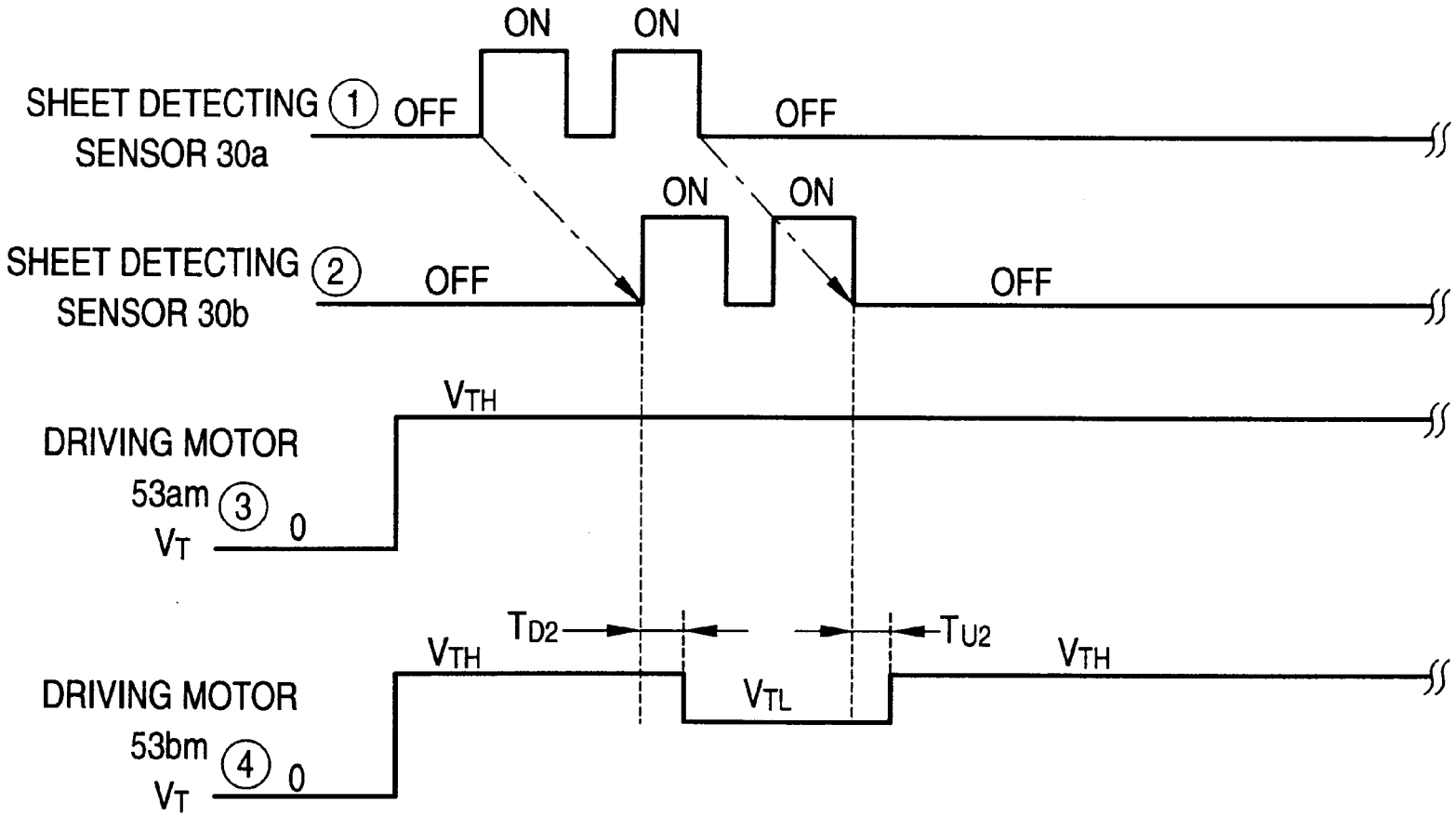
FIG. 11 is a timing chart illustrating the control timing of a transporting speed in the image forming apparatus according to Embodiment 2.

FIGS. 10 and 11 show timing charts illustrating one example of the above-described speed control. In each of FIGS. 10 and 11, a timing chart (1) shows the ON and OFF states of a signal supplied from the sheet detecting sensor 30*a* and indicates the presence and absence of a recording sheet S at an installation position of the sheet detecting sensor 30*a*, while a timing chart (2) shows the ON and OFF states of a signal supplied from the sheet detecting sensor 30*b* and indicates the presence and absence of a recording sheet S at an installation position of the sheet detecting sensor 30*b*. In each of FIGS. 10 and 11, a timing chart (3)

shows a variation in the rotational speed of the driving motor 53*am,* i.e., the transporting speed $V_T$ of the recording sheet S during a transportation by the first belt transporting unit 53*a,* while a timing chart (4) shows a variation in the rotational speed of the driving motor 53*bm,* i.e., the transporting speed $V_T$ of the recording sheet S during a transportation by the second belt transporting unit 53*b.* In each of the first and second belt transporting units 53*a* and 53*b,* the transporting speed $V_T$ takes three values of 0, $V_{TH}$ ($\cong V_P$) and $V_{TL}$ ($\cong V_F$). In this example, two recording sheets S, i.e., the preceding recording sheet $S_p$ and the succeeding recording sheet Sf, are continuously transported. FIG. 10 shows the case in which the transporting-direction length of each of the recording sheets S being transported is comparatively large, while FIG. 11 shows the case in which the transporting-direction length of each of the recording sheets S being transported is comparatively small.

Referring to FIG. 10, the initial value of the transporting speed $V_T$ of each of the first and second belt transporting units 53*a* and 53*b* is 0. Then, at the same time as, for example, the release of the nip of the register roll pair, the speed control means 3 changes the transporting speed $V_T$ of each of the first and second belt transporting units 53*a* and 53*b* from 0 to $V_{TH}$. Then, the leading edge of the preceding recording sheet $S_p$ is detected by the sheet detecting sensor 30*b.*

When the speed control means 3 receives a detection signal from the sheet detecting sensor 30, the speed control means 3 performs two processes at the same time. In one of the two processes, the speed control means 3 activates the built-in software timer or the like and causes it to count time by $T_{D1}$ [sec]. At the timing when the leading edge of the preceding recording sheet $S_p$ reaches a position immediately before the fixing nip portion of the fixing unit 6, the speed control means 3 outputs a control signal to the driving motor 53*ma* so that the transporting speed $V_T$ of the first belt transporting unit 53*a* is changed from $V_{TH}$ to $V_{TL}$. In the other of the two processes, the speed control means 3 activates the built-in software timer or the like and causes it to count time by $T_{D2}$ [sec]. At the timing when the leading edge of the preceding recording sheet $S_p$ reaches a position immediately before the fixing nip portion of the fixing unit 6, the speed control means 3 outputs a control signal to the driving motor 53*mb* so that the transporting speed $V_T$ of the second belt transporting unit 53*b* is changed from $V_{TH}$ to $V_{TL}$.

Then, when the speed control means 3 receives a signal indicating that the trailing edge of the succeeding recording sheet $S_f$ has passed the installation position of the sheet detecting sensor 30*a,* the speed control means 3 causes the built-in software timer or the like to count time by $T_{U1}$ [sec]. At the timing when the trailing edge of the succeeding recording sheet $S_f$ leaves the first belt transporting unit 53*a,* the speed control means 3 outputs a control signal to the driving motor 53*ma* so that the transporting speed $V_T$ is changed from $V_{TL}$ to $V_{TH}$, and the speed control means 3 readies itself to transport the next recording sheet S at the transporting speed $V_T$ approximately equal to the transfer speed $V_P$. In other words, the first belt transporting unit 53*a* can restore the transporting speed $V_T$ to the transporting speed $V_{TH}$ earlier than the second belt transporting unit 53*b,* whereby the productivity of image formation can be improved to a far greater extent. Of course, the preceding recording sheet $S_p$ and the succeeding recording sheet $S_f$ are transported to the fixing unit 6 at a speed approximately equal to the fixing speed $V_F$ in a manner similar to that described previously in connection with the image forming apparatus according to the Embodiment 1.

Then, when the speed control means 3 receives a signal indicating that the trailing edge of the succeeding recording sheet $S_f$ has passed the installation position of the sheet detecting sensor 30*b,* the speed control means 3 causes the built-in software timer or the like to count time by $T_{U2}$ [sec]. At the timing when the trailing edge of the succeeding recording sheet $S_f$ leaves the second belt transporting unit 53*b,* the speed control means 3 outputs a control signal to the driving motor 53*mb* so that the transporting speed $V_T$ is changed from $V_{TL}$ to $V_{TH}$, and the speed control means 3 readies itself to transport the next recording sheet S at the transporting speed $V_T$ approximately equal to the transfer speed $V_P$.

Subsequently, the above-described operation is repeated.

Referring to FIG. 11, the initial value of the transporting speed $V_T$ of each of the first and second belt transporting units 53*a* and 53*b* is 0. Then, at the same time as, for example, the release of the nip of the register roll pair, the speed control means 3 changes the transporting speed $V_T$ of each of the first and second belt transporting units 53*a* and 53*b* from 0 to $V_{TH}$. Then, the leading edge of the preceding recording sheet $S_p$ is detected by the sheet detecting sensor 30*b.*

When the speed control means 3 receives a detection signal from the sheet detecting sensor 30*b,* the speed control means 3 activates the built-in software timer or the like and causes it to count time by $T_{D2}$ [sec]. At the timing when the leading edge of the preceding recording sheet $S_p$ reaches a position immediately before the fixing nip portion of the fixing unit 6, the speed control means 3 outputs a control signal to the driving motor 53*mb* so that the transporting speed $V_T$ of the second belt transporting unit 53*b* is changed from $V_{TH}$ to $V_{TL}$. Then, the preceding recording sheet $S_p$ and the succeeding recording sheet $S_f$ are transported to the fixing unit 6 at the speed $V_T$ approximately equal to the fixing speed $V_F$ in a manner similar to that described previously in connection with the image forming apparatus according to the Embodiment 1.

Then, when the speed control means 3 receives a signal indicating that the trailing edge of the succeeding recording sheet $S_f$ has passed the installation position of the sheet detecting sensor 30*b,* the speed control means 3 causes the built-in software timer or the like to count time by $T_{U2}$ [sec]. At the timing when the trailing edge of the succeeding recording sheet $S_f$ leaves the second belt transporting unit 53*b,* the speed control means 3 outputs a control signal to the driving motor 53*mb* so that the transporting speed $V_T$ is changed from $V_{TL}$ to $V_{TH}$, and the speed control means 3 readies itself to transport the next recording sheet S at the transporting speed $V_T$ approximately equal to the transfer speed $V_P$. During this time, the transporting speed $V_T$ of the first belt transporting unit 53*a* is maintained at $V_{TH}$. Accordingly, the productivity of image formation can be improved.

Subsequently, the above-described operation is repeated.

In the above-described manner, in the speed control according to the present embodiment, if the transporting-direction length of the recording sheet S is comparatively large, the control method shown in FIG. 10 is selected, whereas if the transporting-direction length of the recording sheet S is comparatively small, the control method shown in FIG. 11 is selected. The threshold of the transporting-direction length of the recording sheet S that determines which of the control methods is to be selected can be determined to allow for various kinds of safety margins, according to whether the trailing edge of the recording sheet S is positioned on the first belt transporting unit 53*a* when the leading edge of the recording sheet S reaches the fixing unit 6. For example, in the present embodiment, such threshold is obtained by adding together the distance from the installation position of the sheet detecting sensor 30*b* to a change starting position at which the transporting speed $V_T$ of the second belt transporting unit 53*b* is changed from $V_{TH}$ to $V_{TL}$, the distance from the axial position of the driving roller 532*a* of the first belt transporting unit 53*a* to the installation position of the sheet detecting sensor 30*b* and the allowable slip distance of the recording sheet S over the first and second belt transporting units 53*a* and 53*b*.

Since the transporting speeds $V_{TH}$ and $V_{TL}$ are described previously in connection with Embodiment 1, the description of the transporting speeds $V_{TH}$ and $V_{TL}$ is omitted.

Space Control

This space control for controlling the space X between recording sheets S is similar to the space control of Embodiment 1 in that the recording-sheet space X is dynamically controlled so that the preceding recording sheet $S_p$ and the succeeding recording sheet $S_f$ can be prevented from colliding with each other during transportation and so that the productivity of image formation can be improved. In addition, in the present embodiment, the transporting means is made of the plurality of (two) belt transporting units 53*a* and 53*b*, and if the speed control means 3 independently controls the transporting speeds of the first and second belt transporting units 53*a* and 53*b*, it is possible to improve the productivity of image formation to a further extent.

In other words, if the recording-sheet space X is set to be as narrow as possible by the space control, this setting itself will contribute to an improvement in the productivity of image formation. However, in relation to the above-described speed control, if recording sheets S of small transporting-direction length are to be continuously transported with each of the recording sheets S being spaced from the next one by an extremely small recording-sheet space X, the transporting speed $V_T$ of the upstream-side belt transporting unit (53*a*) must be changed to $V_{TL}$ as in the case of recording sheets S of large transporting-direction length (refer to FIG. 10), and the productivity of image formation becomes low compared to the case in which the transporting speed $V_T$ is maintained at $V_{TH}$ (refer to FIG. 11). To cope with this problem, in the present embodiment, merits and demerits in narrowing the recording-sheet space X are compared and examined in relation to the above-described speed control, whereby a recording-sheet space X which can improve the productivity of image formation to a further extent (does not lower the productivity of image formation) is given.

Incidentally, in the present embodiment as well, the space control does not impose restrictions on layouts or the like in the image forming apparatus, because the recording-sheet space X is appropriately controlled on the basis of the transporting-direction length, transfer speed, fixing speed and transfer position of the preceding recording sheet $S_p$ as well as the length, fixing position and the like of a transporting unit.

One example of the space control will be described below. The technique of the space control is similar to that of Embodiment 1 in that the space control means 4 selects an appropriate computation expression according to the kind of preceding recording sheet $S_p$ and substitutes the transporting-direction length L of the preceding recording sheet $S_p$ into the selected computation expression to obtain an appropriate space X. Accordingly, the description of such technique itself is omitted, and how to obtain a computation expression for the space X will be mainly described below.

Table 5 shows candidates of computation expressions for calculating the space X in the present embodiment.

TABLE 5

| Kind of $S_p$ | Candidate of Computation Expression for Space X |
|---|---|
| Plain Paper | c0 + d0 × L |
| OHP Sheet | c1 + d1 × L |
| Very Thick Paper | c2 + d2 × L |
| Thick Paper | c3 + d3 × L |
| Thin Paper | c4 + d4 × L |

The constants $c_0$ to $c_4$ and $d_0$ to $d_4$ are determined so that the preceding recording sheet $S_p$ and the succeeding recording sheet $S_f$ can be prevented from colliding with each other during transportation and so that the productivity of image formation can be improved. By way of example, the following description will refer to a method of obtaining the constants $c_0$ to $c_4$ and $d_0$ to $d_4$ on the condition (1) that if the leading edge of the succeeding recording sheet $S_f$ reaches the sheet detecting sensor 30, the preceding recording sheet $S_p$ has passed through the nip portion in the fixing unit 6.

Figure 12:
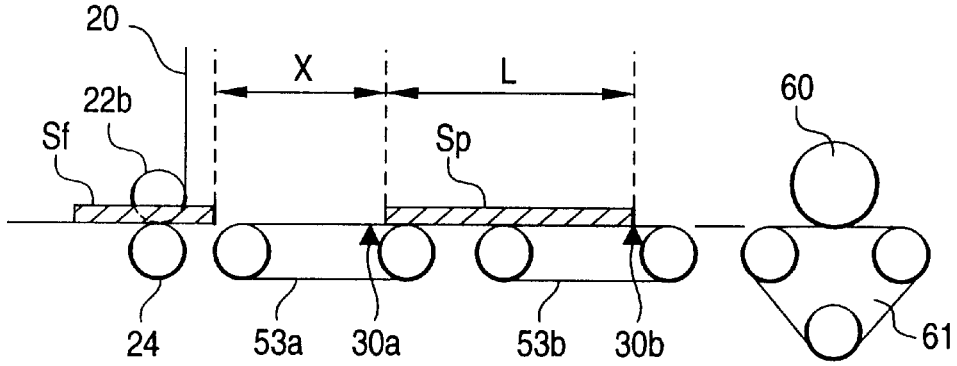
FIGS. 12(*a*), 12(*b*) and 12(*c*) are views illustrating a variation in positional relationship from the secondary transfer unit to the fixing unit.
Figure 12:
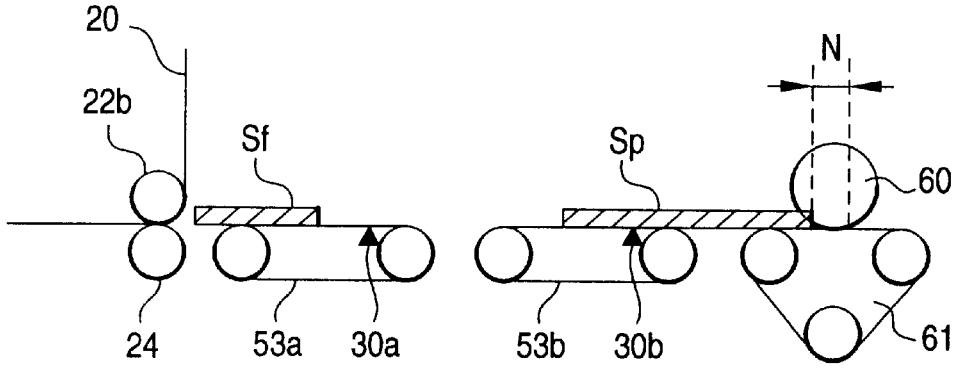
Figure 12:
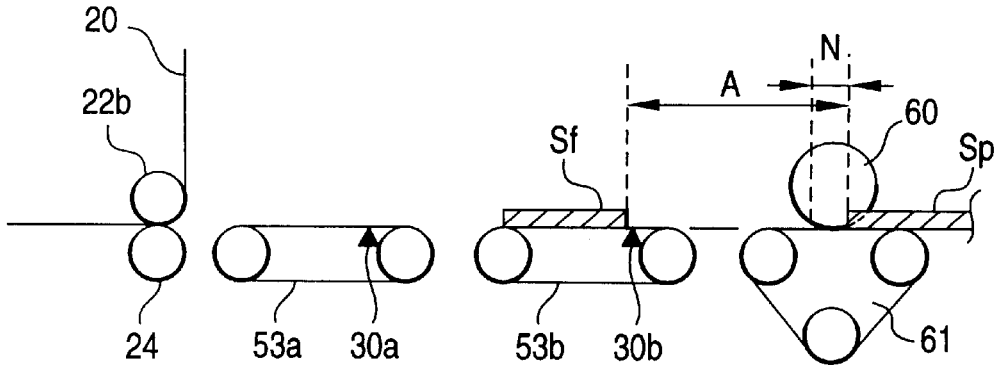

FIGS. 12(*a*) to 12(*c*) are views illustrating the positional relationship between the secondary transfer unit (the transfer section), the fixing unit 6 (the fixing section), the belt transporting unit 53 (the transporting means) and recording sheets S in the present embodiment, and a temporal variation in the positional relationship is shown throughout FIGS. 12(*a*) to 12(*c*).

FIG. 12(*a*) shows the state in which the leading edge of the preceding recording sheet $S_p$ has reached the installation position of the sheet detecting sensor 30*b*. In FIG. 12(*a*), L denotes the transporting-direction length of the preceding recording sheet $S_p$, and X denotes the space between the preceding recording sheet $S_p$ and the succeeding recording sheet $S_f$. FIG. 12(*b*) shows the state in which the leading edge of the preceding recording sheet $S_p$ has reached the nip portion N between the heating roll 60 and the belt pressure assembly 61 in the fixing unit 6. FIG. 12(*c*) shows the state in which the trailing edge of the preceding recording sheet $S_p$ has passed through the nip portion N and the leading edge of the succeeding recording sheet $S_f$ has reached the installation position of the sheet detecting sensor 30*b*. In FIG. 12(*c*), A denotes the distance from the installation position of the sheet detecting sensor 30*b* to the end of the nip portion N.

Letting $t_1$ be the time required for the positional relationship to change from the state shown in FIG. 12(*a*) to the state shown in FIG. 12(*b*), $t_1$ can be expressed as Expression (1), where A–N represents the transporting distance of the preceding recording sheet $S_p$ and $V_{TL}$ represents the transporting speed of the preceding recording sheet Sp. In addition, letting $\Delta X_1$ be the space between the preceding recording sheet $S_p$ and the succeeding recording sheet Sf, which space $\Delta X_1$ becomes narrower during $t_1$, $\Delta X_1$ can be expressed as Expression (2) because, during $t_1$, the preceding recording sheet $S_p$ is transported at the transporting speed $V_{TL}$ and the succeeding recording sheet $S_f$ is transported at the transporting speed $\alpha V_P$ (assuming that the succeeding recording sheet $S_f$ is plain paper).

Letting $t_2$ be the time required for the positional relationship to change from the state shown in FIG. 12(*b*) to the state shown in FIG. 12(*c*), $t_2$ can be expressed as Expression (3), where N+L represents the transporting distance of the preceding recording sheet $S_p$ and $V_F$ represents the transporting speed of the preceding recording sheet Sp. In addition, letting $\Delta X_2$ be the space between the preceding recording sheet $S_p$ and the succeeding recording sheet Sf, which space $\Delta X_2$ becomes narrower during $t_2$, $\Delta X_2$ can be expressed as Expression (4) because, during $t_2$, the preceding recording sheet $S_p$ is transported at the transporting speed $V_F$ and the succeeding recording sheet $S_f$ is transported at the transporting speed $\alpha V_P$ (assuming that the succeeding recording sheet $S_f$ is plain paper).

To meet the above-described condition (1), even if the space X which is given as an initial value becomes narrow during transportation, the space X needs to be not less than A. Therefore, the condition (1) is expressed as Expression (5).

By substituting into Expression (5) the fixing speed $V_P$ and the transporting speed $V_{TL}$ according to each of the kinds of recording sheets S shown in Tables 1 and 2, Expressions (6) to (10) are obtained. For example, Expression (7) gives the range of the space X which satisfies the condition (1) if the preceding recording sheet $S_p$ is an OHP sheet. To improve the productivity of image formation, it is preferable to make the space X as narrow as possible. For this reason, an expression obtained by replacing the inequality sign of Expression (7) with an equality sign is prepared as a candidate of a computation expression for the space X. Specifically, $c_1$ and $d_1$ in the candidate $$(X=c_1+d_1\times L)$$

of a computation expression for calculating the space X if the kind of preceding recording sheet $S_p$ is an OHP sheet are $$c_1=[\{A+(\gamma-1)\times N\}/\gamma]\times\alpha\times V_P\div V_{F1}$$

and $$d_1=(\alpha\times V_P\div V_{F1})-1,$$

respectively. Similarly, candidates of computation expressions for calculating the spaces X relative to the other kinds of preceding recording sheets $S_p$ are prepared, i.e., an expression which is similar to Expression (6) except that the inequality sign thereof is replaced with an equality sign and which is used to calculate the space X if the preceding recording sheet $S_p$ is plain paper, an expression which is similar to Expression (8) except that the inequality sign thereof is replaced with an equality sign and which is used to calculate the space X if the preceding recording sheet $S_p$ is very thick paper, an expression which is similar to Expression (9) except that the inequality sign thereof is replaced with an equality sign and which is used to calculate the space X if the preceding recording sheet $S_p$ is thick paper, and an expression which is similar to Expression (10) except that the inequality sign thereof is replaced with an equality sign and which is used to calculate the space X if the preceding recording sheet $S_p$ is thin paper.

Table 6 shows other candidates of computation expressions for calculating the space X in the present embodiment.

TABLE 6

| Kind of $S_p$ | Candidate of Computation Expression for Space X |
|---|---|
| Plain Paper | e0 + f0 × L |
| OHP Sheet | e1 + f1 × L |
| Very Thick Paper | e2 + f2 × L |
| Thick Paper | e3 + f3 × L |
| Thin Paper | e4 + f4 × L |

The constants $e_0$ to $e_4$ and $f_0$ to $f_4$ are determined so that the productivity improvement effect of the above-described speed control on image formation is not hindered and so that the productivity improvement effect of the space control on image formation can be enhanced as much as possible. By way of example, the following description will refer to a method of obtaining the constants $e_0$ to $e_4$ and $f_0$ to $f_4$ on the condition that if the trailing edge of the preceding recording sheet $S_p$ reaches a position on the axis of the driving roller (532*b*) of the downstream-side belt transporting unit (53*b*), the leading edge of the succeeding recording sheet $S_f$ does not reach a position on the axis of the idle roller 533*b* of the downstream-side belt transporting unit 53*b*, i.e., the space X between the preceding recording sheet $S_p$ and the succeeding recording sheet $S_f$ is not less than the space between the driving roller (532*b*) and the idle roller (533*b*) of the downstream-side belt transporting unit (53*b*) (this condition is hereinafter referred to as the condition (2)).

Figure 13:
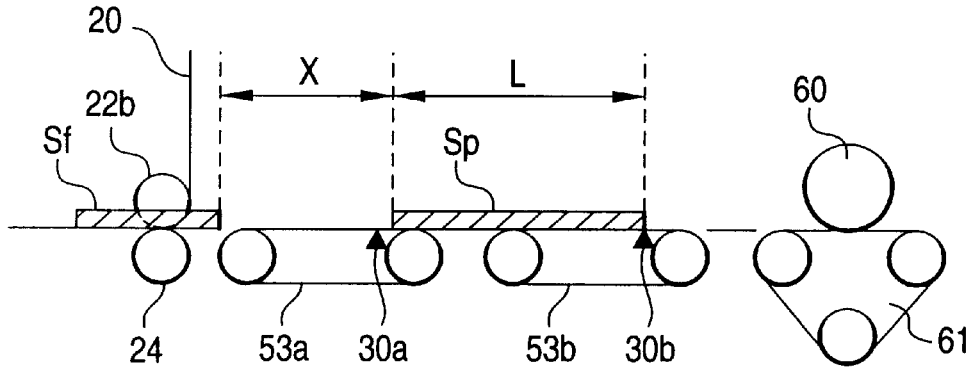
FIGS. 13(*a*), 13(*b*) and 13(*c*) are views illustrating a variation in positional relationship from the secondary transfer unit to the fixing unit.
Figure 13:
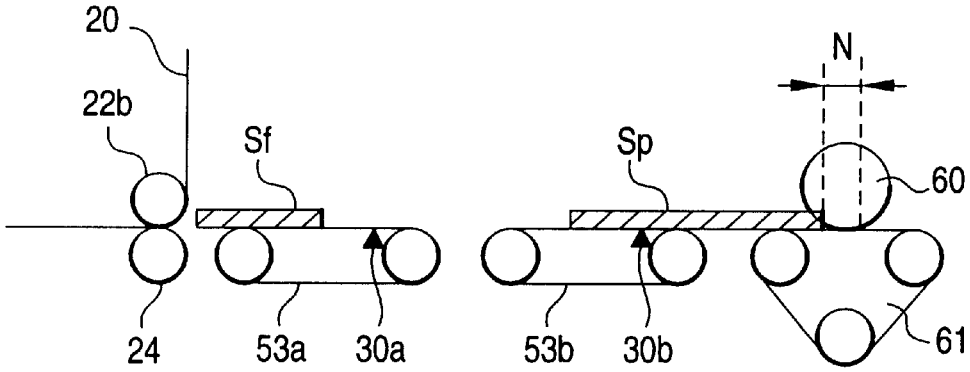
Figure 13:
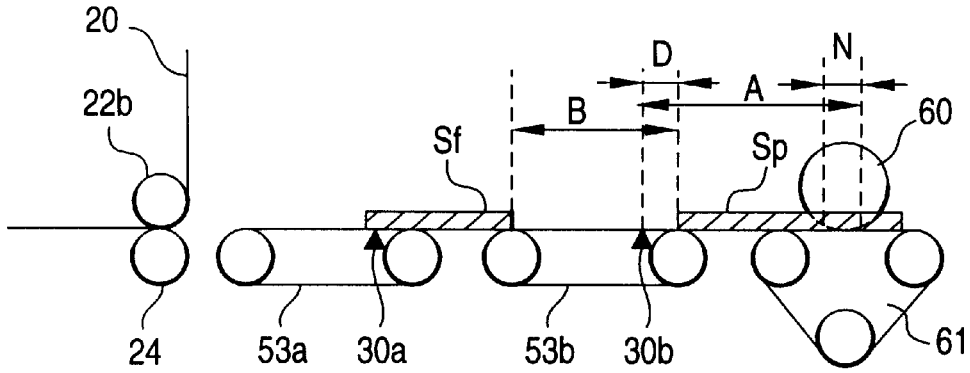

FIGS. 13(*a*), 13(*b*) and 13(*c*) are views illustrating the positional relationship between the secondary transfer unit (the transfer section), the fixing unit 6 (the fixing section), the belt transporting unit 53 (the transporting means) and recording sheets S in the present embodiment, and a temporal variation in the positional relationship is shown throughout FIGS. 13(*a*) to 13(*c*).

FIG. 13(*a*) shows the state in which the leading edge of the preceding recording sheet $S_p$ has reached the installation position of the sheet detecting sensor 30*b*. In FIG. 13(*a*), L denotes the transporting-direction length of the preceding recording sheet $S_p$, and X denotes the space between the preceding recording sheet $S_p$ and the succeeding recording sheet $S_f$. FIG. 13(*b*) shows the state in which the leading edge of the preceding recording sheet $S_p$ has reached the nip portion N between the heating roll 60 and the belt pressure assembly 61 in the fixing unit 6. FIG. 13(*c*) shows the state in which the trailing edge of the preceding recording sheet $S_p$ has reached a position on the axis of the driving roller 532*b* and the leading edge of the succeeding recording sheet $S_f$ has reached a position on the axis of the idle roller 533*b*. In FIG. 13(*c*), B denotes the distance between the axis of the idle roller 533*b* of the second belt transporting unit 53*b* and the axis of the driving roller 532*b*, and D denotes the distance between the installation position of the sheet detecting sensor 30*b* and the axis of the driving roller 532*b*.

Letting $t_1$ be the time required for the positional relationship to change from the state shown in FIG. 13(*a*) to the state shown in FIG. 13(*b*), $t_1$ can be expressed as Expression (1), where A−N represents the transporting distance of the preceding recording sheet $S_p$ and $V_{TL}$ represents the transporting speed of the preceding recording sheet Sp. In addition, letting $\Delta X_1$ be the space between the preceding recording sheet $S_p$ and the succeeding recording sheet $S_f$, which space $\Delta X_1$ becomes narrower during $t_1$, $\Delta X_1$ can be expressed as Expression (2) because, during $t_1$, the preceding recording sheet $S_p$ is transported at the transporting speed $V_{TL}$ and the succeeding recording sheet $S_f$ is transported at the transporting speed $\alpha V_P$ (assuming that the succeeding recording sheet $S_f$ is plain paper).

Expression 5

$$t_3=\{L-(A-N)+D\}/V_F \tag{11}$$

$$\Delta X_3=t_3\times(\alpha V_P-V_F)$$

$$=\{L-(A-N)+D\}/V_F\times(\alpha V_P-V_F) \tag{12}$$

Letting $t_3$ be the time required for the positional relationship to change from the state shown in FIG. 13(*b*) to the state shown in FIG. 13(*c*), $t_3$ can be expressed as Expression (11), where L−(A−N)+D represents the transporting distance of the preceding recording sheet $S_p$ and $V_F$ represents the transporting speed of the preceding recording sheet $S_p$. In addition, letting $\Delta X_3$ be the space between the preceding recording sheet $S_p$ and the succeeding recording sheet $S_f$, which space $\Delta X_3$ becomes narrower during $t_3$, $\Delta X_3$ can be expressed as Expression (12) because, during $t_3$, the preceding recording sheet $S_p$ is transported at the transporting speed $V_F$ and the succeeding recording sheet $S_f$ is transported at the transporting speed $\alpha V_P$ (assuming that the succeeding recording sheet $S_f$ is plain paper).

Expression 6

$$X-\Delta X_1-\Delta X_3 \geqq B \tag{13}$$

To meet the above-described condition (2), even if the space X which is given as an initial value becomes narrow during transportation, the space X needs to be not less than B. Therefore, the condition (2) is expressed as Expression (13).

Expression 7

$$X \geqq B-D+A-N+(D+N-A)\times\alpha/\beta+(\alpha\div\beta-1)\times L \tag{14}$$

$$X \geqq B-D+\{(A-N)\div\gamma+D+N-A\}\times(\alpha V_P\div V_{Ft})+(\alpha V_P V_{Ft}-1)\times L \tag{15}$$

$$X \geqq B-D+\{(A-N)\div\gamma+D+N-A\}\times(\alpha V_P\div V_{F2})+(\alpha V_P/V_{F3}-1)\times L \tag{16}$$

$$X \geqq B-D+\{(A-N)\div\gamma+D+N-A\}\times(\alpha V_P\div V_{F3})+(\alpha V_P/V_{F3}-1)\times L \tag{17}$$

$$X \geqq B-D+\{(A-N)\div\gamma+D+N-A\}\times(\alpha V_P\div V_{F4})+(\alpha V_P/V_{F4}-1)\times L \tag{18}$$

By substituting into Expression (13) the fixing speed $V_F$ and the transporting speed $V_{TL}$ according to each of the kinds of recording sheets S shown in Tables 1 and 2, Expressions (14) to (18) are obtained. For example, Expression (15) gives the range of the space X which satisfies the condition (2) if the preceding recording sheet $S_p$ is an OHP sheet. To improve the productivity of image formation, it is preferable to make the space X as narrow as possible. For this reason, an expression obtained by replacing the inequality sign of Expression (15) with an equality sign is prepared as a candidate of a computation expression for the space X. Specifically, $e_1$ and $f_1$ in the candidate $$(X=e_1+g_1\times L)$$

of a computation expression for calculating the space X if the kind of preceding recording sheet $S_p$ is an OHP sheet are $$e_1=B-D+[\{(A-N)\div\gamma\}+D+N-A]\times\alpha\times V_P\div V_{F1}$$

and $$f_1=(\alpha\times V_P\div V_{F1})-1,$$

respectively. Similarly, candidates of computation expressions for calculating the spaces X relative to the other kinds of preceding recording sheets $S_p$ are prepared, i.e., an expression which is similar to Expression (14) except that the inequality sign thereof is replaced with an equality sign and which is used to calculate the space X if the preceding recording sheet $S_p$ is plain paper, an expression which is similar to Expression (16) except that the inequality sign thereof is replaced with an equality sign and which is used to calculate the space X if the preceding recording sheet $S_p$ is very thick paper, an expression which is similar to Expression (17) except that the inequality sign thereof is replaced with an equality sign and which is used to calculate the space X if the preceding recording sheet $S_p$ is thick paper, and an expression which is similar to Expression (18) except that the inequality sign thereof is replaced with an equality sign and which is used to calculate the space X if the preceding recording sheet $S_p$ is thin paper.

TABLE 7

| Kind of $S_9$ | Computation Expression for Space X |
|---|---|
| Plain Paper | max(c0 + d0 × L, e0 + f0 × L) |
| OHP Sheet | max(c1 + d1 × L, e1 + f1 × L) |
| Very Thick Paper | max(c2 + d2 × L, e2 + f2 × L) |
| Thick Paper | max(c3 + d3 × L, e3 + f3 × L) |
| Thin Paper | max(c4 + d4 × L, e4 + f4 × L) |

As described above, Table 5 shows the computation expressions for calculating the spaces X which satisfy the condition (1) according to the respective kinds of preceding recording sheets $S_p$, and Table 6 shows the computation expressions for calculating the spaces X which satisfy the condition (2) according to the respective kinds of preceding recording sheets Sp. In the present embodiment, as shown in Table 7, the computation expressions for calculating the spaces X between recording sheets S, which are stored in the space control means 4, are those which correspond to larger spaces X and satisfy both the condition (1) and the condition (2) according to the respective kinds of preceding recording sheets Sp.

Figure 14:
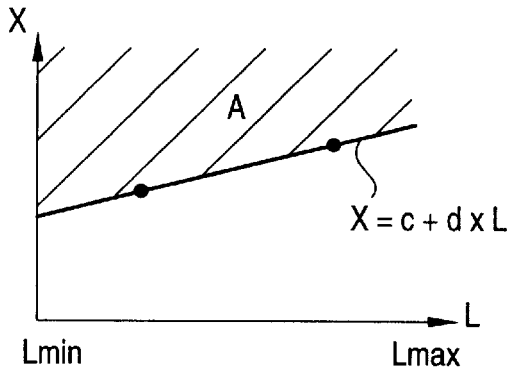
FIGS. 14(*a*), 14(*b*) and 14(*c*) are views illustrating the range of a space X which satisfies two conditions.
Figure 14:
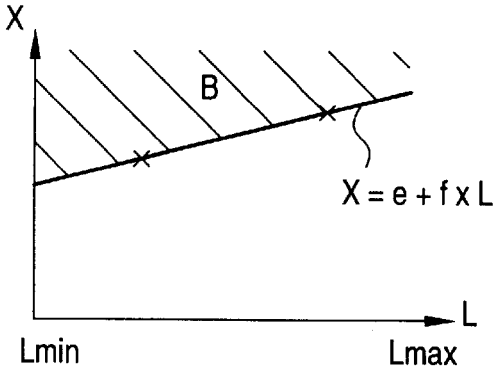
Figure 14:
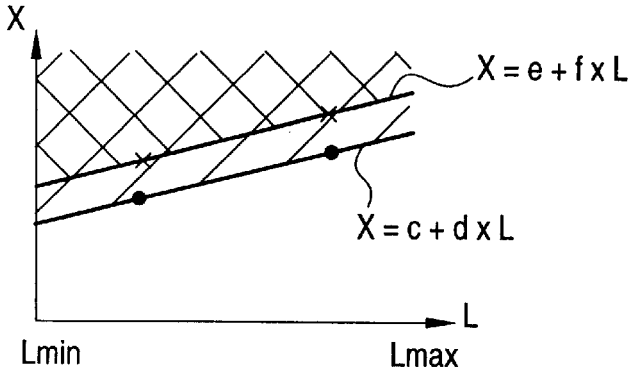

FIGS. 14(*a*) to 14(*c*) are views illustrating the computation expressions shown in Table 7. In the case of a certain kind of preceding recording sheet $S_p$, the range of the space X which satisfies the condition (1) is shown by a shaded portion A in FIG. 14(*a*), and the range of the space X which satisfies the condition (2) is shown by a shaded portion B in FIG. 14(*b*). If both straight-line graphs assume the positional relationship shown in FIG. 14(*c*), a computation expression for calculating the space X which satisfies both the conditions (1) and (2) is $$X=e+f\times L.$$

In the present embodiment, as can be seen from the comparison of, for example, Expressions (6) to (10) and Expressions (14) to (18), the constants d and f which are coefficients of the variable L are equal to each other and the inclinations of the straight-line graphs are parallel to each other as shown in FIG. 14(*c*). Therefore, it is determined in advance which of the computation expressions is to be selected as a computation expression for calculating space X when the constant C and the constant e are compared with each other, and the space control means 4 actually stores only a computation expression having a larger constant (the larger one between the constant C and the constant e). For example, if $c_1$ is larger than $e_1$, the space control means 4 stores only $$X=c_1+d_1\times L$$

as a computation expression for calculating the space X if the kind of preceding recording sheet $S_p$ is an OHP sheet.

In this manner, the space control means 4 stores plural kinds (five kinds) of computation expressions according to the kinds of preceding recording sheets Sp.

The space control means 4 selects an appropriate computation expression from among the stored plural kinds of computation expressions according to the kind of preceding recording sheet $S_p$, and substitutes the transporting-direction length L of the preceding recording sheet $S_p$ into the selected computation expression and obtains the space X between the preceding recording sheet $S_p$ and the succeeding recording sheet $S_f$, thereby controlling a xerographic process so that the space X is ensured. Thus, the succeeding recording sheet $S_f$ is actually transported in the state of being spaced from the preceding recording sheet $S_p$ by the space X.

For example, if the preceding recording sheet $S_p$ is an OHP sheet and its transporting-direction length is 210 mm, the space control means 4 selects $$X=\max(c_1+d_1\times L,\ e_1+f_1\times L)$$

as a computation expression and substitutes 210 for L to obtain $$X=\max(c_1+d_1\times 210,\ e_1+f_1\times 210)=c_1+d_1\times 210$$

as the space X between the preceding recording sheet $S_p$ and the succeeding recording sheet $S_f$, and executes control based on the obtained space X (because $c_1>e_1$, $d_1=f_1$). Incidentally, a decision as to the kind of preceding recording sheet $S_p$ is made in a manner similar to that described previously in connection with Embodiment 1.

As described above, in the present embodiment, the constant d and the constant f which are the coefficients of the variable L become equal to each other, but there is a case in which the constant d and the constant f become different from each other according to how to obtain the constant d and the constant f. In this case as well, the space control means 4 store the computation expressions for the spaces X shown in Table 7, and needs only to control the spaces X on the basis of the computation expressions.

Figure 15:
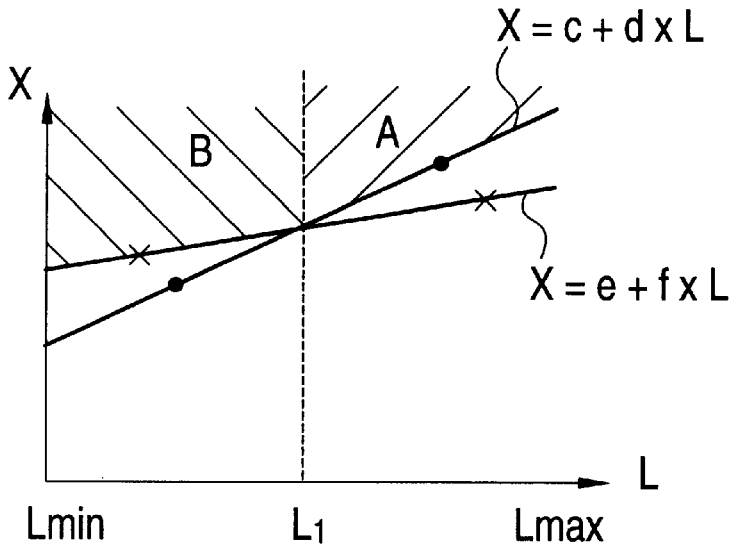
FIGS. 15(*a*) and 15(*b*) are views illustrating the range of a space X which satisfies two conditions.
Figure 15:
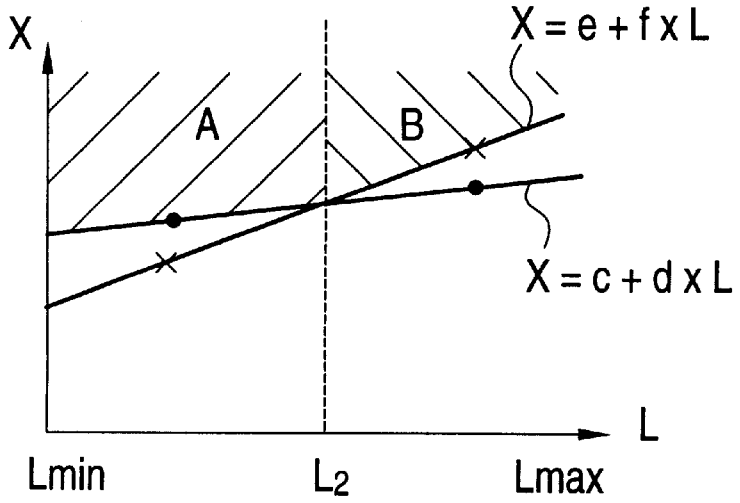

FIGS. 15(*a*) and 15(*b*) show two examples in each of which the constant d and the constant f differ from each other. In the example shown in FIG. 15(*a*), if the transporting-direction length of the preceding recording sheet $S_p$ is between $L_{min}$ and $L_1$, the range of the space X which satisfies both conditions (1) and (2) is the range shown by a shaded portion B in FIG. 15(*a*), and $$X=e+f\times L$$

is adopted as a computation expression for the space X. If the transporting-direction length of the preceding recording sheet $S_p$ is between $L_1$ and $L_{MAX}$, the range of the space X which satisfies both conditions (1) and (2) is the range shown by a shaded portion A in FIG. 15(*a*), and $$X=c+d\times L$$

is adopted as a computation expression for the space X. On the other hand, in the example shown in FIG. 15(*b*), if the transporting-direction length of the preceding recording sheet $S_p$ is between $L_{min}$ and $L_2$, the range of the space X which satisfies both conditions (1) and (2) is the range shown by a shaded portion A in FIG. 15(*b*), and $$X=c+d\times L$$

is adopted as a computation expression for the space X. If the transporting-direction length of the preceding recording sheet $S_p$ is between $L_2$ and $L_{max}$, the range of the space X which satisfies both conditions (1) and (2) is the range shown by a shaded portion B in FIG. 15(*b*), and $$X=e+f\times L$$

is adopted as a computation expression for the space X.

Modification

In the space control of Embodiment 2, the constants $c_0$ to $c_4$, $d_0$ to $d_4$, $e_0$ to $e_4$ and $f_0$ to $f_4$ are obtained on the assumption that the succeeding recording sheet $S_f$ is plain paper. However, in the case of actual image formation, the succeeding recording sheet $S_f$ may be of a kind other than plain paper, for example, an OHP sheet or thick paper.

In the present modification, the space control means 4 stores plural kinds of computation expressions which give not only a space X corresponding to the kind of preceding recording sheet $S_p$ but also a space X corresponding to the kind of succeeding recording sheet Sf. The space control means 4 selects appropriate computation expressions from among the stored plural kinds of computation expressions according to the kind of preceding recording sheet $S_p$ and the kind of succeeding recording sheet $S_f$, and substitutes the transporting-direction length L of the preceding recording sheet $S_p$ into each of the selected computation expressions and obtains the space X between the preceding recording sheet $S_p$ and the succeeding recording sheet $S_f$, thereby controlling a xerographic process so that the space X is ensured. Thus, the succeeding recording sheet $S_f$ is actually transported in the state of being spaced from the preceding recording sheet $S_p$ by the space X.

TABLE 8

| Kind of $S_p$ | Computation Expression for Space X (Sf: Plain Paper) |
|---|---|
| Plain Paper | max(c0 + d0 × L, e0 + f0 × L) |
| OHP Sheet | max(c1 + d1 × L, e1 + f1 × L) |
| Very Thick Paper | max(c2 + d2 × L, e2 + f2 × L) |
| Thick Paper | max(c3 + d3 × L, e3 + f3 × L) |
| Thin Paper | max(c4 + d4 × L, e4 + f4 × L) |

TABLE 9

| Kind of $S_p$ | Computation Expression for Space X (Sf: Other Than Plain Paper) |
|---|---|
| Plain Paper | max(c0' + d0' × L, e0' + f0' × L) |
| OHP Sheet | max(c1' + d1' × L, e1' + f1' × L) |
| Very Thick Paper | max(c2' + d2' × L, e2' + f2' × L) |
| Thick Paper | max(c3' + d3' × L, e3' + f3' × L) |
| Thin Paper | max(c4' + d4' × L, e4' + f4' × L) |

One example of the above-described space control will be described below. Tables 8 and 9 show computation expressions for calculating the recording-sheet spaces X which are stored in the space control means 4. In this example, the space control means 4 stores different computation expressions according to whether the kind of succeeding recording sheet $S_f$ is plain paper (Table 8) or other than plain paper (Table 9).

For example, if the preceding recording sheet $S_p$ is an OHP sheet and its transporting-direction length is 210 mm and the succeeding recording sheet $S_f$ is thick paper (other than plain paper), the space control means 4 selects $$X=\max(c_1'+d_1'\times L,\ e_1'+f_1'\times L)$$

as a computation expression and substitutes 210 for L to obtain $$X=\max(c_1'+d_1'\times 210,\ e'+f_1'210)$$

as the space X between the preceding recording sheet $S_p$ and the succeeding recording sheet $S_f$, and executes control based on the obtained space X. Incidentally, decisions as to the kind of preceding recording sheet $S_p$ and the kind of succeeding recording sheet $S_f$ can be made in a manner similar that described previously in connection with Embodiment 1.

A method of obtaining the constants $c_0'$ to $c_4'$ and $d_0'$ to $d_4'$ to satisfy the above-described condition (1) as well as $e_0'$ to $e_4'$ and $f_0'$ to $f_4'$ to satisfy the above-described condition (2) will be described below.

Expressions (1) to (5) are used for obtaining the constants $c_0$ to $c_4$ and $d_0$ to $d_4$ (and the constants $a_0$ to $a_4$ and $b_0$ to $b_4$), and among Expressions (1) to (5), the portions of Expressions (2) and (4) which are marked with wavy underlines are related to the kind of succeeding recording sheet Sf. Each of these portions marked with wavy underlines means the transporting speed $V_{TH}$ of the succeeding recording sheet $S_f$, and in Expressions (2) and (4), since it is assumed that the kind of succeeding recording sheet $S_f$ is plain paper, the transporting speed $V_{TH}$ is calculated as $\alpha \times V_P$. Therefore, the transporting speed $V_{TH}$ of each of the portions marked with wavy underlines can be changed according to the kind of succeeding recording sheet $S_f$, and the constants $c_0'$ to $c_4'$ and $d_0'$ to $d_4'$ can be obtained in a manner similar to that described previously in connection with Embodiment 2 (and Embodiment 1). If the kind of succeeding recording sheet $S_f$ is other than plain paper, the transporting speed $V_{TH}$ is a constant value of $\gamma \times V_P$ (refer to Table 2). Accordingly, if $\gamma \times V_P$ is substituted for $\alpha \times V_P$ in each of the portions marked with wavy underlines in Expressions (2) and (4), the constants $c_0'$ to $c_4'$ and $d_0'$ to $d_4'$ can be obtained in a manner similar to that described previously in connection with Embodiment 2 (and Embodiment 1). Candidates of the computation expressions for the spaces X are shown in Table 10.

TABLE 10

| | Candidate of Computation Expression for Space X | |
|---|---|---|
| Kind of $S_p$ | $S^f$: Plain Paper | $S^f$: Other Than Plain Paper |
| Plain Paper | c0 + d0 × L | c0' + d0' × L |
| OHP Sheet | c1 + d1 × L | c1' + d1' × L |
| Very Thick Paper | c2 + d2 × L | c2' + d2' × L |
| Thick Paper | c3 + d3 × L | c3' + d3' × L |
| Thin Paper | c4 + d4 × L | c4' + d4' × L |

Expressions (1) and (2) and Expressions (11), (12) and (13) are used for obtaining the constants $e_0$ to $e_4$ and $f_0$ to $f_4$, and among these expressions, the portions of Expressions (2) and (12) which are marked with wavy underlines are related to the kind of succeeding recording sheet $S_f$. Each of these portions marked with wavy underlines means the transporting speed $V_{TH}$ of the succeeding recording sheet $S_f$, and in Expressions (2) and (12), since it is assumed that the kind of succeeding recording sheet $S_f$ is plain paper, the transporting speed $V_{TH}$ is calculated as $\alpha \times V_P$. Therefore, the transporting speed $V_{TH}$ of each of the portions marked with wavy underlines can be changed according to the kind of succeeding recording sheet Sf, and the constants $c_0'$ to $c_4'$ and $d_0'$ to $d_4'$ can be obtained in a manner similar to that described previously in connection with Embodiment 2. If the kind of succeeding recording sheet $S_f$ is other than plain paper, the transporting speed $V_{TH}$ is a constant value of $\gamma \times V_P$ (refer to Table 2). Accordingly, if $\gamma \times V_P$ is substituted for $\alpha \times V_P$ in each of the portions marked with wavy underlines in Expressions (2) and (12), the constants $e_0'$ to $e_4'$ and $f_0'$ to $f_4'$ can be obtained in a manner similar to that described previously in connection with Embodiment 2. Candidates of the computation expressions for the spaces X are shown in Table 11.

TABLE 11

| | Candidate of Computation Expression for Space X | |
|---|---|---|
| Kind of $S_p$ | $S^f$: Plain Paper | $S^f$: Other Than Plain Paper |
| Plain Paper | e0 + f0 × L | e0' + f0' × L |
| OHP Sheet | e1 + f1 × L | e1' + f1' × L |

TABLE 11-continued

| | Candidate of Computation Expression for Space X | |
|---|---|---|
| Kind of $S_p$ | $S^f$: Plain Paper | $S^f$: Other Than Plain Paper |
| Very Thick Paper | e2 + f2 × L | e2' + f2' × L |
| Thick Paper | e3 + f3 × L | e3' + f3' × L |
| Thin Paper | e4 + f4 × L | e4' + f4' × L |

In this example, there are only two kinds of transporting speeds $V_{TH}$ of recording sheets S, i.e., $\alpha \times V_P$ for plain paper and $\gamma \times V_P$ for the kinds other than plain paper (refer to Table 2). Therefore, in this modification as well, since the kinds of succeeding recording sheets $S_f$ are plain paper and other than plain paper and five kinds of preceding recording sheets $S_p$ are usable, the space control means 4 only stores computation expressions for ten kinds of spaces X (2×5) in total. However, for example, if five kinds of transporting speeds $V_{TH}$ of recording sheets S are present for the respective kinds of recording sheets S, the space control means 4 may store computation expressions for calculating five different spaces X for the respective five kinds of succeeding recording sheets $S_f$ and five different spaces X for the respective five kinds of preceding recording sheets $S_p$, a total of twenty-five kinds of spaces X (5×5).

As a matter of course, the present invention can be applied to various kinds of image forming apparatus other than those referred to above in the description of Embodiment 1 and Embodiment 2. For example, the developing unit of Embodiment 1 may be a so-called rotary developing unit which is rotatable. Although either of Embodiment 1 or Embodiment 2 has been described in connection with a color image forming apparatus, the present invention can, of course, be applied to a monochromatic image forming apparatus as well. However, since the fixing speed needs to be set to a slower speed in the formation of a color image, the present invention can serve a more remarkable effect in a color image forming apparatus. Furthermore, it is a matter of course that the computation expressions for the space X are merely examples and different computation expressions can be obtained in terms of other transporting conditions and the like. For example, the space X may be determined by adding a predetermined safety margin to each of the computation expressions used in each of the embodiments.

As described above in detail, it is possible to provide an image forming apparatus which can compatibly realize if maintenance of optimum fixing speeds according to fixing characteristics of recording sheets S and toner images and a reduction in the size of the apparatus itself as well as an improvement in the productivity of image formation, and which is free of many restrictions such as sizes, transfer speeds, fixing speeds and transfer positions of recording media to be used as well as lengths and fixing positions of transporting units.

What is claimed is:

1. An image forming apparatus comprising:

a transfer section that transfers a toner image formed on an image carrier by a xerographic process to recording sheets at a predetermined transfer speed;

a fixing section that fixes the toner image transferred to the recording sheet to the recording sheet at a predetermined fixing speed different from the predetermined transfer speed, said fixing section being disposed so that a distance between said fixing section and said transfer section is longer than a maximum transporting-direction length of a recording sheet on which an image can be formed;

a transporting system that continuously transports the recording sheet from said transfer section to said fixing section at a predetermined transporting speed and with a predetermined space;

a sheet detecting sensor that detects a position of the recording sheet;

a controller that controls a transporting speed of said transporting system based on the position so that a transporting speed and a fixing speed of the recording sheet become approximately equal to each other when a leading edge of the recording sheets transported by said transporting system reaches said fixing section; and a space controller that controls a space between a preceding recording sheet and a succeeding recording sheet according to a transporting-direction length of the preceding recording sheet of recording sheets which are continuously transported by said transporting system.

2. An image forming apparatus according to claim 1, wherein when said fixing section fixes the toner image to the recording sheet at a fixing speed corresponding to a fixing characteristic of the recording sheet and/or the toner image, said space controller controls the space between the preceding recording sheet and the succeeding recording sheet according to the fixing speed.

3. An image forming apparatus according to claim 1, wherein when said transporting system includes a plurality of transporting units and said speed controller independently controls transporting speeds of said respective transporting units, said space controller controls the space between the preceding recording sheet and the succeeding recording sheet according to the transporting speeds of said respective transporting units.

4. An image forming apparatus according to claim 1, wherein said space controller determines a space X between the preceding recording sheet and the succeeding recording sheet on the basis of a linear expression of L which is:

$$X=a+b\times L,$$

wherein L represents a transporting-direction length of the preceding recording sheet and a and b represent constants determined on the basis of a transporting condition.

5. An image forming apparatus according to claim 4, wherein the constants a and b are determined on the basis of the fixing speed and/or the transporting speed.

6. An image forming apparatus according to claim 5, wherein when said fixing section selects a fixing speed from among a plurality of fixing speeds predetermined according to the fixing characteristic of the recording sheet and/or the toner image and fixes the toner image to the recording sheet at the selected fixing speed, said space controller determines the constants a and b by selecting a set of constants a and b from among a plurality of sets of constants a and b predetermined according to the plurality of fixing speeds.

7. An image forming apparatus according to claim 1, further comprising a detecting device that detects a transporting-direction length of the recording sheet, said space controller controlling the space between the preceding recording sheet and the succeeding recording sheet on the basis of a detection result of said detecting device.

8. An image forming apparatus comprising:

a transfer section that transfers a toner image formed on an image carrier by a xerographic process to recording sheets at a predetermined transfer speed;

a fixing section that fixes the toner image transferred to the recording sheet to the recording sheet at a predetermined fixing speed different from the predetermined transfer speed, said fixing section being disposed so that a distance between said fixing section and said transfer section is longer than a maximum transporting-direction length of a recording sheet on which an image can be formed;

a transporting system that continuously transports the recording sheet from said transfer section to said fixing section at a predetermined transporting speed and with a predetermined space;

a sheet detecting sensor that detects a position of the recording sheet;

a controller that controls a transporting speed of said transporting system based on the position so that a transporting speed and a fixing speed of the recording sheet become approximately equal to each other when a leading edge of the recording sheet transported by said transporting system reaches said fixing section; and a space controller that controls a space between a preceding recording sheet and a succeeding recording sheet according to a fixing speed of the preceding recording sheet of recording sheets which are continuously transported by said transporting system.

9. An image forming apparatus according to claim 8, wherein the fixing speed is a speed predetermined according to a fixing characteristic of the-recording sheet and/or the toner image.

* * * * *